US009206542B2

(12) United States Patent
Choi et al.

(10) Patent No.: US 9,206,542 B2
(45) Date of Patent: Dec. 8, 2015

(54) DRYING MACHINE AND METHOD FOR CONTROLLING THE SAME

(75) Inventors: Chul Jin Choi, Changwon-si (KR); Dae Bong Yang, Jinbae-si (KR); Chong Ryu, Busan (KR); Jea Hyuk Wee, Busan (KR); Young Soo Kim, Changwon-si (KR); Sang Hun Bae, Changwon-si (KR); Chang Woo Son, Busan (KR); Dong Hyun Kim, Changwon-si (KR); Young Bok Son, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 328 days.

(21) Appl. No.: 12/506,773

(22) Filed: Jul. 21, 2009

(65) Prior Publication Data

US 2009/0277035 A1 Nov. 12, 2009

Related U.S. Application Data

(62) Division of application No. 11/706,435, filed on Feb. 15, 2007.

(30) Foreign Application Priority Data

Feb. 20, 2006 (KR) ..... 10-2006-0016246
Jun. 12, 2006 (KR) ..... 10-2006-0052681

(51) Int. Cl.
*F26B 11/02* (2006.01)
*D06F 58/20* (2006.01)
(Continued)

(52) U.S. Cl.
CPC ..... *D06F 58/203* (2013.01); *D06F 58/04* (2013.01); *D06F 58/28* (2013.01)

(58) Field of Classification Search
CPC ..... D06F 58/203; D06F 58/28; D06F 58/20; D06F 58/04
USPC ..... 34/130, 595, 597, 60, 90
See application file for complete search history.

(56) References Cited

U.S. PATENT DOCUMENTS 1,338,696 A 5/1920 Power
1,398,490 A 11/1921 Arthur
(Continued)

FOREIGN PATENT DOCUMENTS

CN 1580359 2/2005
CN 1609327 4/2005
(Continued)

OTHER PUBLICATIONS

German Office Action dated Apr. 21, 2010.
(Continued)

*Primary Examiner* — Jiping Lu
(74) *Attorney, Agent, or Firm* — Ked & Associates LLP

(57) ABSTRACT

A drying machine is disclosed. The drying machine includes a selectively rotatable drum receiving an object to be dried, a steam supply member having one side connected to a steam generator and the other side connected to the drum, and a swirler installed in the steam supply member at a predetermined position for swirling steam flowing through the steam supply member. A method for controlling the drying machine includes heating a drum, supplying steam generated in a steam generator into the drum, and supplying hot air into the drum. The drying machine having the above described configuration can efficiently eliminate creases of clothes.

30 Claims, 23 Drawing Sheets

(51) Int. Cl.
*D06F 58/04* (2006.01)
*D06F 58/28* (2006.01)

(56) References Cited

U.S. PATENT DOCUMENTS 1,549,537 A 8/1925 Henry
1,567,709 A 12/1925 Carroll
1,601,431 A 9/1926 Maurice
1,786,191 A 12/1930 Carroll
1,909,384 A 5/1933 Kirk
1,965,480 A 7/1934 Nicola
1,998,912 A 4/1935 Max
RE19,986 E 5/1936 Silver
2,050,625 A 8/1936 Orr
2,114,776 A 4/1938 Ernest
2,506,476 A 5/1950 Max
2,523,305 A 9/1950 Johnson
2,595,663 A 5/1952 Howland
2,687,578 A 8/1954 Richterkessing
2,712,182 A 7/1955 Vetorino
2,726,664 A * 12/1955 Webber ..... 131/236
2,758,461 A 8/1956 David
2,920,471 A 1/1960 Ramon
2,927,379 A 3/1960 Tann
2,929,674 A 3/1960 David
3,020,648 A 2/1962 Strike
3,032,887 A 5/1962 Whyte et al.
3,066,423 A 12/1962 Solem
3,121,000 A 2/1964 Hubbard
3,242,584 A 3/1966 Jacobs
3,256,617 A 6/1966 Goldberger
3,285,589 A 11/1966 Worst
3,402,576 A 9/1968 Krupsky
3,442,692 A 5/1969 Gaiser
3,601,292 A 8/1971 Bliss
3,619,919 A 11/1971 Mcmillan
3,627,008 A * 12/1971 Samuelian ..... 241/199.12
3,643,341 A 2/1972 Magin
3,651,580 A 3/1972 Meyer
3,808,846 A 5/1974 Fleissner
3,811,202 A 5/1974 Arendt
3,826,682 A 7/1974 Liebowitz
3,866,333 A 2/1975 Sarukahanian et al.
4,003,136 A 1/1977 Vincent et al.
4,065,253 A 12/1977 Bullock
4,106,214 A 8/1978 Schmidt
4,137,645 A 2/1979 Bullock
4,167,594 A 9/1979 Schwadtke et al.
4,207,683 A 6/1980 Horton ..... 34/60
4,237,622 A 12/1980 Francis
4,267,643 A 5/1981 Haried
4,268,247 A 5/1981 Freze
4,285,219 A 8/1981 Grunewald
4,338,730 A 7/1982 Tatsumi et al.
4,414,765 A 11/1983 Kreinberg et al.
4,520,577 A 6/1985 Suissa
4,599,814 A 7/1986 Geiger
4,622,039 A 11/1986 Merenda
4,652,390 A 3/1987 Strampach et al.
4,735,738 A 4/1988 Willman
4,761,305 A 8/1988 Ochiai
4,781,041 A 11/1988 Fowler
4,797,128 A 1/1989 Fowler
4,797,656 A 1/1989 Keppler
4,800,655 A 1/1989 Mori et al.
4,936,920 A 6/1990 Keritsis et al.
5,042,524 A 8/1991 Lund
5,050,259 A 9/1991 Tsubaki et al.
5,050,313 A 9/1991 Wakaeya et al.
5,107,606 A 4/1992 Tsubaki et al.
5,212,969 A 5/1993 Tsubaki et al.
5,289,703 A 3/1994 Hiyashi et al.
5,343,632 A 9/1994 Dinh
5,367,787 A 11/1994 Ikeda et al.
5,376,144 A 12/1994 McClain et al.
5,431,205 A * 7/1995 Gebhard ..... 141/351
5,443,541 A 8/1995 St. Louis
5,477,623 A 12/1995 Tomizawa et al.
5,546,678 A 8/1996 Dhaemers
5,557,704 A 9/1996 Dennis et al.
5,600,975 A 2/1997 McClain et al.
5,613,379 A * 3/1997 Kim ..... 68/17 R
5,621,370 A 4/1997 St. Louis
5,673,497 A 10/1997 St. Louis
5,704,230 A 1/1998 McClain et al.
5,709,201 A 1/1998 Puett
5,789,368 A 8/1998 You et al.
5,840,675 A 11/1998 Yeazell
5,863,299 A 1/1999 Holt et al.
5,872,090 A 2/1999 You et al.
5,891,197 A 4/1999 Young et al.
5,943,720 A 8/1999 Chung
5,979,435 A 11/1999 Puett
6,115,539 A * 9/2000 Cohn ..... 392/402
6,161,306 A 12/2000 Clodic
6,184,193 B1 2/2001 Yamada
6,233,771 B1 5/2001 Hortel et al.
6,243,969 B1 6/2001 Yeazell
6,262,009 B1 7/2001 Rogers et al.
6,324,771 B1 12/2001 McAllister et al.
6,434,857 B1 8/2002 Anderson et al.
6,510,280 B1 1/2003 Chen
6,514,924 B1 2/2003 Van Hauwermeiren et al.
6,576,323 B2 6/2003 Wise et al.
6,585,781 B1 7/2003 Roseen
6,673,121 B2 1/2004 Mettlach et al.
6,684,440 B1 2/2004 Wise et al.
6,691,536 B2 2/2004 Severns et al.
6,745,496 B2 6/2004 Casella
6,759,006 B1 7/2004 Siklosi et al.
6,796,055 B2 9/2004 Baltes
6,818,293 B1 11/2004 Keep et al.
6,833,032 B1 12/2004 Douglas et al.
6,857,296 B2 2/2005 Fagg et al.
6,868,621 B1 3/2005 Grimm et al.
6,898,951 B2 5/2005 Severns et al.
6,904,703 B2 6/2005 Naganawa et al.
6,916,751 B1 7/2005 Kronzer
6,928,752 B2 8/2005 Johnson et al.
6,979,495 B2 12/2005 Keung et al.
7,020,983 B2 4/2006 Bolduan et al.
7,066,412 B2 6/2006 Conley et al.
7,073,356 B2 7/2006 Nakamura et al.
7,089,768 B2 8/2006 Bolduan et al.
7,162,812 B2 1/2007 Cimetta et al.
7,220,365 B2 5/2007 Qu et al.
7,275,400 B2 10/2007 Severns et al.
7,305,856 B2 12/2007 Bolduan et al.
7,325,330 B2 2/2008 Kim et al.
7,356,945 B2 4/2008 Choi et al.
7,390,778 B1 6/2008 Strang et al.
7,418,789 B2 9/2008 Choi et al.
7,481,005 B2 1/2009 Bolduan et al.
7,520,145 B2 4/2009 Hong et al.
7,543,396 B2 6/2009 Nishino et al.
7,600,402 B2 10/2009 Shin et al.
7,607,246 B2 10/2009 Valiyambath et al.
7,621,155 B2 11/2009 Ahn
7,624,466 B2 12/2009 Kim et al.
7,647,663 B2 1/2010 Kim et al.
7,654,073 B2 2/2010 Primlani
7,665,227 B2 2/2010 Wright et al.
7,735,345 B2 6/2010 Wright et al.
7,814,770 B2 10/2010 Jeon et al.
7,882,716 B2 2/2011 Noro et al.
7,895,770 B2 3/2011 Bae et al.
7,905,120 B2 3/2011 Mamiya et al.
7,914,607 B2 3/2011 Moschutz et al.
7,921,578 B2 4/2011 McAllister et al.
7,930,838 B2 4/2011 Bae et al.
7,934,279 B2 5/2011 Son
7,942,025 B1 5/2011 Musone
8,650,772 B2 2/2014 Son et al. ..... 34/524
2001/0022007 A1 9/2001 Yeacell

(56) References Cited

U.S. PATENT DOCUMENTS

2001/0055692 A1 12/2001 Heffelfinger
2002/0073491 A1 6/2002 Metlach et al.
2002/0133886 A1 9/2002 Severns et al.
2002/0133969 A1 9/2002 Casella
2002/0155308 A1 10/2002 Heffelfinger et al.
2002/0184715 A1 12/2002 Taylor
2003/0000106 A1 1/2003 Anderson et al.
2003/0017958 A1 1/2003 Wise et al.
2003/0061841 A1 4/2003 Nakamura et al.
2003/0066638 A1 4/2003 Qu et al.
2003/0087781 A1 5/2003 Van Hauwermeiren et al.
2003/0224965 A1 12/2003 Conley et al.
2003/0233766 A1 12/2003 Balduan et al.
2004/0000068 A1 1/2004 Balduan et al.
2004/0000174 A1 1/2004 Balduan et al.
2004/0000175 A1 1/2004 Balduan et al.
2004/0010937 A1 1/2004 Naganawa et al.
2004/0038842 A1 2/2004 Fagg et al.
2004/0045187 A1 3/2004 Curry et al.
2004/0064966 A1 4/2004 Baltes
2004/0112095 A1 6/2004 Balduan et al.
2004/0129032 A1 7/2004 Severns et al.
2004/0187529 A1 9/2004 Kim et al.
2004/0194339 A1 10/2004 Johnson et al.
2004/0214984 A1 10/2004 Keep et al.
2005/0000033 A1 1/2005 Park et al.
2005/0014673 A1 1/2005 Kwitkowski et al.
2005/0034248 A1 2/2005 Oh et al.
2005/0050644 A1 3/2005 Severns et al.
2005/0050756 A1 3/2005 Casella
2005/0081308 A1 4/2005 Kim et al.
2005/0092035 A1 5/2005 Shin et al.
2005/0115120 A1 6/2005 Cevik
2005/0172511 A1 8/2005 Cimetta et al.
2005/0189289 A1* 9/2005 Hsiao ..... 210/456
2005/0217035 A1 10/2005 Steiner et al.
2005/0223503 A1 10/2005 Hong et al.
2005/0223504 A1 10/2005 Lee et al.
2005/0262644 A1 12/2005 Oak et al.
2005/0274157 A1* 12/2005 Yang ..... 68/17 R
2005/0278983 A1 12/2005 Rydberg
2006/0005571 A1 1/2006 Lifson et al.
2006/0005581 A1 1/2006 Banba
2006/0016020 A1 1/2006 Park
2006/0086001 A1 4/2006 Jeong et al.
2006/0090524 A1 5/2006 Jeon et al.
2006/0101588 A1 5/2006 Park et al.
2006/0112585 A1 6/2006 Choi et al.
2006/0117596 A1 6/2006 Kim et al.
2006/0123854 A1* 6/2006 Hong et al. ..... 68/19.1
2006/0130354 A1 6/2006 Choi et al.
2006/0137105 A1 6/2006 Hong et al.
2006/0137107 A1 6/2006 Lee et al.
2006/0150689 A1 7/2006 Kim et al.
2006/0151009 A1 7/2006 Kim et al.
2006/0194712 A1 8/2006 Conley et al.
2006/0201209 A1 9/2006 Lee et al.
2006/0254082 A1 11/2006 Kim
2006/0277690 A1 12/2006 Pyo et al.
2007/0062513 A1 3/2007 Gagas
2007/0101773 A1 5/2007 Park et al.
2007/0151041 A1 7/2007 McAllister et al.
2007/0151129 A1 7/2007 McAllister et al.
2007/0151310 A1 7/2007 Wright et al.
2007/0151311 A1 7/2007 McAllister et al.
2007/0151312 A1 7/2007 Bruce et al.
2007/0163093 A1 7/2007 Wright et al.
2007/0163094 A1 7/2007 Wright et al.
2007/0163095 A1 7/2007 McAllister et al.
2007/0163096 A1 7/2007 McAllister et al.
2007/0163097 A1 7/2007 Metcalfe et al.
2007/0163098 A1 7/2007 Tomasi et al.
2007/0180728 A1 8/2007 Kim et al.
2007/0186593 A1 8/2007 Ahn
2007/0199352 A1 8/2007 Saal et al.
2007/0209228 A1 9/2007 Meerpohl et al.
2007/0227030 A1 10/2007 Oh et al.
2007/0261715 A1 11/2007 Lee et al.
2007/0266587 A1 11/2007 Bringewatt et al.
2008/0000098 A1 1/2008 Choi et al.
2008/0026131 A1 1/2008 Benjamin et al.
2008/0034808 A1 2/2008 Cho
2008/0052950 A1 3/2008 Park et al.
2008/0053162 A1 3/2008 Park et al.
2008/0053164 A1 3/2008 Park et al.
2008/0053166 A1 3/2008 Lim
2008/0099051 A1 5/2008 Kim et al.
2008/0099052 A1 5/2008 Lee et al.
2008/0115380 A1 5/2008 Nishino et al.
2008/0115381 A1 5/2008 Bae et al.
2008/0115540 A1 5/2008 Nishino et al.
2008/0141550 A1 6/2008 Bae et al.
2008/0141552 A1 6/2008 Bae et al.
2008/0141553 A1 6/2008 Son et al.
2008/0141554 A1 6/2008 Bae et al.
2008/0141557 A1 6/2008 Son et al.
2008/0141558 A1 6/2008 Bae et al.
2008/0141734 A1 6/2008 Son et al.
2008/0148494 A1 6/2008 Son et al.
2008/0148596 A1 6/2008 Son et al.
2008/0168679 A1 7/2008 Son et al.
2008/0196410 A1 8/2008 Primlani
2008/0209757 A1 9/2008 Park et al.
2008/0229936 A1 9/2008 Kaneko et al.
2008/0250822 A1 10/2008 Ahn
2008/0256720 A1 10/2008 Park et al.
2008/0256989 A1 10/2008 Jeong et al.
2008/0263783 A1 10/2008 Pyo
2008/0271263 A1 11/2008 Bae et al.
2008/0271500 A1 11/2008 Ahn
2008/0272934 A1 11/2008 Wang et al.
2008/0276381 A1 11/2008 Son
2008/0276659 A1 11/2008 Bae et al.
2008/0276660 A1 11/2008 Bae et al.
2008/0276661 A1 11/2008 Bae et al.
2008/0282751 A1 11/2008 Yoon et al.
2008/0289212 A1 11/2008 Moon et al.
2008/0302138 A1 12/2008 Bae et al.
2008/0313922 A1 12/2008 Bae et al.
2009/0025557 A1 1/2009 Moschutz et al.
2009/0038084 A1 2/2009 Lee et al.
2009/0049872 A1 2/2009 Noro et al.
2009/0049874 A1 2/2009 Mamiya et al.
2009/0064421 A1 3/2009 Lee et al.
2009/0064725 A1 3/2009 Lim et al.
2009/0071032 A1 3/2009 Kreutzfeldt et al.
2009/0077755 A1 3/2009 Park et al.
2009/0078007 A1 3/2009 Bae et al.
2009/0083988 A1 4/2009 Yoon et al.
2009/0083990 A1 4/2009 Bae et al.
2009/0095032 A1 4/2009 Lee
2009/0100882 A1 4/2009 Bae et al.
2009/0113745 A1 5/2009 Choi et al.
2009/0113755 A1 5/2009 Choi et al.
2009/0113944 A1 5/2009 Kim et al.
2009/0120140 A1 5/2009 Choi et al.
2009/0126222 A1 5/2009 Bae et al.
2009/0126421 A1 5/2009 Kim et al.
2009/0126423 A1 5/2009 Bae et al.
2009/0133281 A1 5/2009 Yoon et al.
2009/0133298 A1 5/2009 Kim et al.
2009/0139037 A1 6/2009 Jeong et al.
2009/0139277 A1 6/2009 Park et al.
2009/0159301 A1 6/2009 Chatot et al.
2009/0172967 A1 7/2009 Son et al.
2009/0183532 A1 7/2009 Kim et al.
2009/0193592 A1 8/2009 Stefanich et al.
2009/0199424 A1 8/2009 Bae et al.
2009/0201124 A1 8/2009 Kim et al.
2009/0211109 A1 8/2009 Choi et al.
2009/0235553 A1 9/2009 Bae et al.
2009/0235555 A1 9/2009 Ji
2009/0241606 A1 10/2009 Yoo et al.
2009/0249639 A1 10/2009 Kim et al.

(56) References Cited

U.S. PATENT DOCUMENTS

| | | | |
|---|---|---|---|
| 2009/0249839 | A1 | 10/2009 | Moon et al. |
| 2009/0255146 | A1 | 10/2009 | Klug et al. |
| 2009/0255299 | A1 | 10/2009 | Hiro et al. |
| 2009/0260246 | A1 | 10/2009 | Bae et al. |
| 2009/0260250 | A1 | 10/2009 | Moon et al. |
| 2009/0265953 | A1 | 10/2009 | Bae et al. |
| 2009/0277035 | A1 | 11/2009 | Choi et al. |
| 2009/0277036 | A1 | 11/2009 | Lee et al. |
| 2009/0277037 | A1 | 11/2009 | Lim |
| 2009/0282695 | A1 | 11/2009 | Kreutzfeldt et al. |
| 2009/0282696 | A1 | 11/2009 | Kim et al. |
| 2009/0288456 | A1 | 11/2009 | Bae et al. |
| 2009/0307921 | A1 | 12/2009 | Bae et al. |
| 2009/0320213 | A1 | 12/2009 | Lee et al. |
| 2009/0320313 | A1 | 12/2009 | Bae et al. |
| 2009/0320314 | A1 | 12/2009 | Jo et al. |
| 2009/0320318 | A1 | 12/2009 | Kim et al. |
| 2009/0320530 | A1 | 12/2009 | Kim et al. |
| 2010/0000117 | A1 | 1/2010 | Choi et al. |
| 2010/0000268 | A1 | 1/2010 | Kohne et al. |
| 2010/0000269 | A1 | 1/2010 | Shin et al. |
| 2010/0005598 | A1 | 1/2010 | Jung |
| 2010/0005681 | A1 | 1/2010 | Jo et al. |
| 2010/0018072 | A1 | 1/2010 | Kim et al. |
| 2010/0018262 | A1 | 1/2010 | Beihoff et al. |
| 2010/0024243 | A1 | 2/2010 | Ricklefs et al. |
| 2010/0043245 | A1 | 2/2010 | Noviello |
| 2010/0050464 | A1 | 3/2010 | Krzelowski et al. |
| 2010/0050465 | A1 | 3/2010 | Im et al. |
| 2010/0058608 | A1 | 3/2010 | Moon et al. |
| 2010/0058610 | A1 | 3/2010 | Kim et al. |
| 2010/0058814 | A1 | 3/2010 | Kim et al. |
| 2010/0058815 | A1 | 3/2010 | Lim et al. |
| 2010/0077628 | A1 | 4/2010 | Bae et al. |
| 2010/0077801 | A1 | 4/2010 | Son et al. |
| 2010/0083445 | A1 | 4/2010 | Kim et al. |
| 2010/0083711 | A1 | 4/2010 | Han et al. |
| 2010/0095716 | A1 | 4/2010 | Bae et al. |
| 2010/0101280 | A1 | 4/2010 | Im et al. |
| 2010/0107433 | A1 | 5/2010 | Paruzzolo et al. |
| 2010/0115784 | A1 | 5/2010 | Jo et al. |
| 2010/0115785 | A1 | 5/2010 | Ben-Shmuel et al. |
| 2010/0115788 | A1 | 5/2010 | Kim et al. |
| 2010/0115790 | A1 | 5/2010 | Arreghini |
| 2010/0139334 | A1 | 6/2010 | Kim et al. |
| 2010/0141013 | A1 | 6/2010 | Lahr |
| 2010/0147040 | A1 | 6/2010 | Kim et al. |
| 2010/0154250 | A1 | 6/2010 | Bae et al. |
| 2010/0180465 | A1 | 7/2010 | Noviello et al. |
| 2010/0186176 | A1 | 7/2010 | Wright et al. |
| 2010/0206016 | A1 | 8/2010 | Bae et al. |
| 2010/0229607 | A1 | 9/2010 | Persson et al. |
| 2010/0236001 | A1 | 9/2010 | Lee et al. |
| 2010/0257902 | A1 | 10/2010 | Persson et al. |
| 2010/0269266 | A1 | 10/2010 | Lee et al. |
| 2010/0281929 | A1 | 11/2010 | Han et al. |
| 2011/0005276 | A1 | 1/2011 | Moon et al. |
| 2011/0016743 | A1 | 1/2011 | Jung et al. |
| 2011/0016928 | A1 | 1/2011 | Beihoff et al. |
| 2011/0023321 | A1 | 2/2011 | Jung |
| 2011/0030147 | A1 | 2/2011 | Yoo et al. |
| 2011/0030427 | A1 | 2/2011 | Santarossa et al. |
| 2011/0030428 | A1 | 2/2011 | Han et al. |
| 2011/0032072 | A1 | 2/2011 | Han et al. |
| 2011/0041258 | A1 | 2/2011 | Ko et al. |
| 2011/0050441 | A1 | 3/2011 | Han et al. |
| 2011/0054843 | A1 | 3/2011 | Han et al. |
| 2011/0054844 | A1 | 3/2011 | Han et al. |
| 2011/0054845 | A1 | 3/2011 | Han et al. |
| 2011/0054967 | A1 | 3/2011 | Han et al. |
| 2011/0060553 | A1 | 3/2011 | Han et al. |
| 2011/0067457 | A1 | 3/2011 | Han et al. |
| 2011/0075589 | A1 | 3/2011 | Han et al. |
| 2011/0107617 | A1 | 5/2011 | Lee et al. |

FOREIGN PATENT DOCUMENTS

| | | | | |
|---|---|---|---|---|
| CN | 1644787 | | | 7/2005 |
| CN | 1696384 | | | 11/2005 |
| DE | 1544345 | | | 7/1969 |
| DE | 10332656 | | | 7/2004 |
| DE | 10302866 | | | 8/2004 |
| DE | 102007007354 | | | 10/2007 |
| EP | 150728 | | | 8/1985 |
| EP | 1275767 | | | 1/2003 |
| EP | 1441059 | A1 | | 7/2004 |
| EP | 1544345 | | | 6/2005 |
| EP | 1666655 | | | 6/2006 |
| EP | 1669668 | A1 | | 6/2006 |
| EP | 1862584 | A1 | | 5/2007 |
| EP | 1900865 | A1 | | 3/2008 |
| EP | 1932963 | A1 | | 6/2008 |
| EP | 1936021 | A2 | | 6/2008 |
| EP | 1939349 | A2 | | 7/2008 |
| EP | 2014820 | A1 | | 1/2009 |
| JP | 01175896 | A | | 7/1989 |
| JP | 01175897 | A | | 7/1989 |
| JP | 01265999 | A | | 10/1989 |
| JP | 06071093 | A | | 3/1994 |
| JP | 06233898 | | | 8/1994 |
| JP | 07000690 | A | | 1/1995 |
| JP | 08252395 | A | | 10/1996 |
| JP | 09173697 | A | | 7/1997 |
| JP | 10076251 | A | * | 3/1998 |
| JP | 10192595 | A | | 7/1998 |
| JP | 11276799 | | | 10/1999 |
| JP | 2000-018782 | | | 1/2000 |
| JP | 2000018782 | A | * | 1/2000 |
| JP | 2005048916 | A | * | 2/2005 |
| JP | 2005083708 | A | | 3/2005 |
| JP | 2005130956 | | | 5/2005 |
| JP | 2006029649 | A | | 2/2006 |
| KR | 10-2004-0015957 | | | 2/2004 |
| KR | 100640788 | | | 11/2005 |
| WO | WO 2006101358 | A1 | | 9/2006 |
| WO | WO 2006101360 | A1 | | 9/2006 |
| WO | WO 2006101377 | | | 9/2006 |
| WO | WO 2006126815 | A2 | | 11/2006 |
| WO | WO2007145432 | A1 | | 12/2007 |
| WO | WO2007145451 | A2 | | 12/2007 |
| WO | WO2007145448 | A2 | | 1/2008 |
| WO | WO2008010671 | A2 | | 1/2008 |
| WO | WO2008013426 | A2 | | 1/2008 |
| WO | WO 2008016261 | A2 | | 2/2008 |
| WO | WO2008038959 | A2 | | 4/2008 |
| WO | WO2010114332 | A2 | | 10/2010 |

OTHER PUBLICATIONS

Notice of Allowance for related U.S. Appl. No. 11/980,736 dated Jun. 2, 2011.

Office Action for related U.S. Appl. No. 11/706,435 dated Jun. 22, 2011.

Office Action for related U.S. Appl. No. 12/304,309 dated Aug. 4, 2011.

Chinese Patent Gazette dated Jun. 15, 2011.

Office Action dated Sep. 29, 2009 from parent U.S. Appl. No. 11/706,435, filed Feb. 15, 2007.

Chinese Office Action dated Sep. 25, 2009.

Korean Office Action dated Mar. 6, 2008.

Chinese Patent Gazette dated Jan. 19, 2011.

U.S. Office Action dated Dec. 7, 2010 for U.S. Appl. No. 11/706,435.

U.S. Office Action dated Jan. 26, 2011 for U.S. Appl. No. 11/980,736.

Office Action dated Mar. 30, 2010 for Parent U.S. Appl. No. 11/706,435.

Office Action for related U.S. Appl. No. 12/304,309 dated Jan. 4, 2012.

Office Action issued in U.S. Appl. No. 12/304,309 dated May 7, 2012.

(56) References Cited

OTHER PUBLICATIONS

U.S. Appl. No. 11/706,435, filed Feb. 15, 2007, Jiping Lu.
U.S. Appl. No. 12/304,309, filed Dec. 11, 2008, John Patrick McCormack.
European Search Report dated Mar. 19, 2014, issued in Application No. 07793152.5-1710/2027327.
European Search Report dated May 13, 2014, issued in Application No. 09012535.2-1710/2133460.

* cited by examiner

DRYING MACHINE AND METHOD FOR CONTROLLING THE SAME

This application claims the benefit of U.S. patent application Ser. No. 11/706,435 filed Feb. 15, 2007, which claims priority to Korean Patent Application No. 10-2006-0016246 filed on Feb. 20, 2006, and No. 10-2006-0052681 filed on Jun. 12, 2006, which are hereby incorporated by reference as if fully set forth herein.

BACKGROUND OF THE INVENTION

1. Field of the Invention

The present invention relates to a method for controlling a drying machine, and more particularly, to a method for controlling a drying machine, which can eliminate or prevent wrinkles or creases, etc. generated in clothes and the like.

2. Discussion of the Related Art

Drying machines may be classified on the basis of the manner of air heating, that is to say on the means of heating, into an electric drying machine and a gas drying machine. The electric drying machine uses hot air by use of heat from electric resistance, and the gas drying machine uses hot air by use of heat generated via burning of gas. With another classification manner, drying machines also may be classified into a condensing-type drying machine and an exhausting-type drying machine. In the condensing-type drying machine, humid air is generated in a drum via heat exchange between air and a wet object to be dried, and circulated within the drying machine rather than being discharged out of the drying machine. In this case, the humid air is again exchange heat with outside air in a separate condenser, and the resulting condensate water is discharged to the outside. On the other hand, in the exhausting-type drying machine, the humid air, which was generated in a drum via heat exchange between air and a wet object to be dried, is directly discharged out of the drying machine. With yet another classification manner, drying machines may be classified, on the basis of a manner of placing a wet object to be dried into the drying machine, into a top loading drying machine and a front loading drying machine. The top loading drying machine is designed such that a wet object to be dried is placed from the top side of the drying machine. The front loading drying machine is designed such that a wet object to be dried is placed from the front side of the drying machine. The above described conventional drying machines, however, have the following problems.

In general, laundry, which has completely washed and dehydrated, is inputted into a drying machine, so as to be dried in the drying machine. However, due to the principle of washing, the completely washed laundry inevitably has creases, and the generated creases are difficult to be completely eliminated in a drying course that is performed in the drying machine. Accordingly, conventional drying machines have a disadvantage in that additional ironing is necessary to eliminate creases generated in an object, such as laundry, which has completely dried in the drying machine.

Also, in addition to the completely washed laundry, clothes, etc., which are stored in a conventional manner or worn by wearers, are not free from wrinkles, creases, folds, and the like (hereinafter, generally referred to as "creases"). Accordingly, there is an urgent requirement for development of a device that is capable of expediently eliminating creases generated in clothes, etc. stored in a conventional manner or worn by wearers.

SUMMARY OF THE INVENTION

Accordingly, the present invention is directed to a drying machine and a method for controlling the same that substantially obviate one or more problems due to limitations and disadvantages of the related art.

An object of the present invention is to provide a drying machine which can prevent and/or eliminate creases generated in clothes, etc., and a method for controlling the drying machine.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a drying machine comprises: a selectively rotatable drum receiving an object to be dried; a steam supply member having one side connected to a steam generator and the other side connected to the drum; and a swirler installed in the steam supply member at a predetermined position for swirling steam flowing through the steam supply member.

Preferably, the swirler is located adjacent to a tip end of the steam supply member, and includes at least one blade for guiding flow of steam. The blade extends from an inner wall of the steam supply member to the center of the steam supply member, and is integrally formed with the steam supply member.

In accordance with another aspect of the present invention, there is provided a method for controlling a drying machine comprising: heating a drum; supplying steam generated in a steam generator into the drum; and supplying hot air into the drum.

Preferably, the method for controlling the drying machine further comprises cooling the drum. In addition, after completing the supply of steam, the method for controlling the drying machine further comprises: discharging water remaining in the steam generator to the outside, for withdrawal of the water. During the withdrawal of the water, the water remaining in the steam generator is pumped to the outside. Also, during the heating of the drum, and during the supply of steam, the drum is tumbled. The drum is intermittently tumbled.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Hereinafter, to explain a drying machine and a method for controlling the same according to the present invention, an exemplary embodiment related to a top loading electric condensing drying machine will be described for convenient explanation. However, it will be appreciated by those skilled in the art that the present invention is not limited thereto and may be applied to a front loading gas condensing drying machine, etc.

Figure 1:
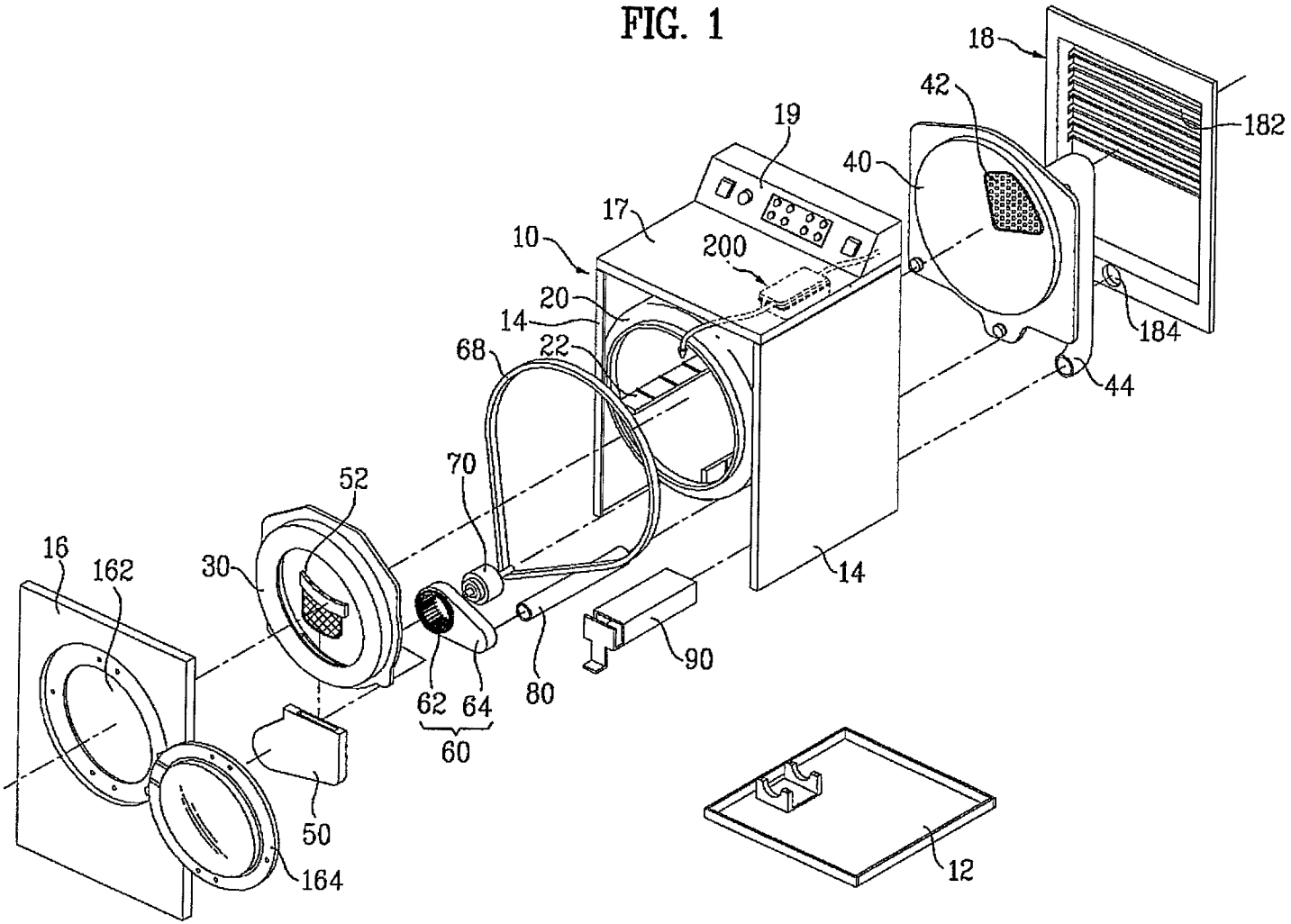
FIG. 1 is an exploded perspective view illustrating an exemplary embodiment of a drying machine according to the present invention.
Figure 2:
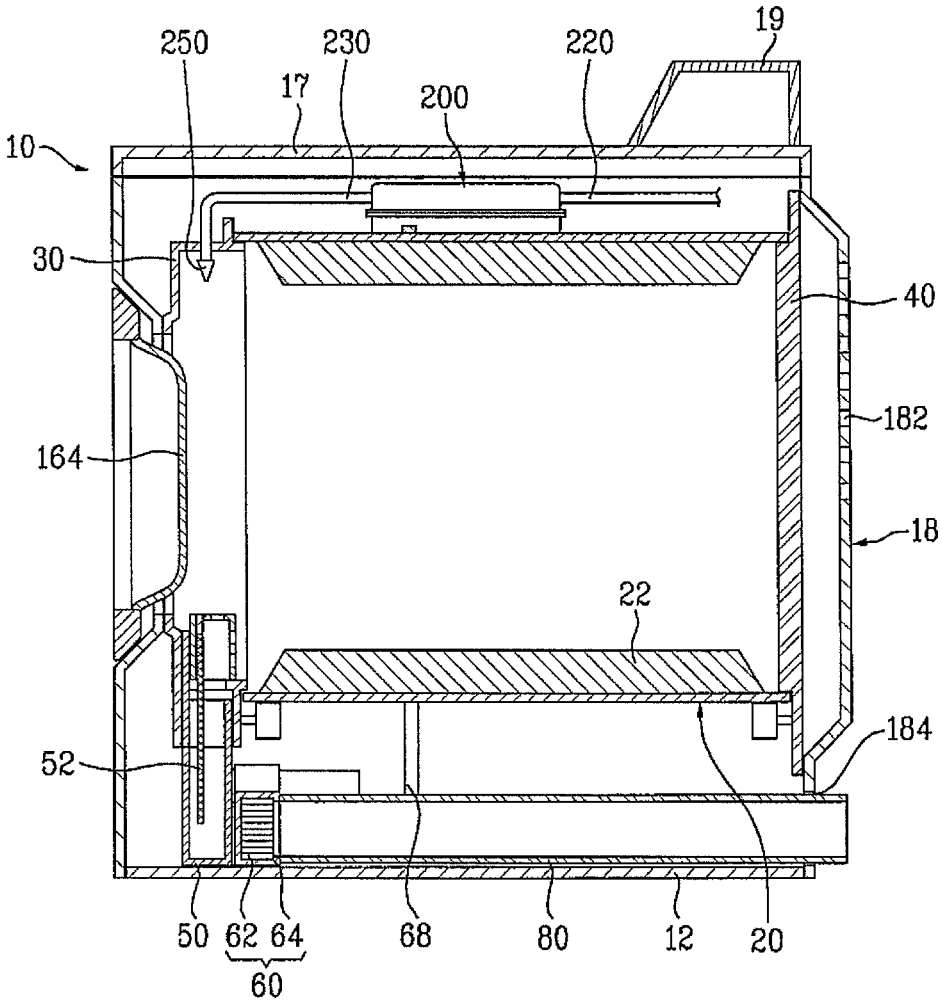
FIG. 2 is a longitudinal sectional view of FIG. 1.

First, referring to FIGS. 1 and 2, a drying machine and a method for controlling the same according to an exemplary embodiment of the present invention will be described.

The drying machine comprises a cabinet 10 defining the outer appearance of the drying machine, a rotatable drum 20 installed in the cabinet 10, and a motor 70 and a belt 68 installed in the cabinet 10 for driving the drum 20. A heater 90 is also installed in the cabinet 10 at a predetermined position and adapted to heat air, so as to generate high-temperature air (hereinafter, referred to as "hot air" for convenient explanation). Hereinafter, the heater 90 is referred to as "hot air heater" for convenient explanation. In addition, to supply the hot air generated from the hot air heater 90 into the drum 20, a hot air supply duct 44 is installed in the cabinet 10 at a predetermined position. The drying machine further comprises an exhaust duct 80 for discharging humid air generated via heat exchange between air and a wet object received in the drum 20, a blower unit 60 for suctioning the humid air, etc. Meanwhile, a steam generator 200 for generating high-temperature steam is installed in the cabinet 10 at a predetermined position. Although the present embodiment describes an indirect drive type in which the drum 20 is rotated by the motor 70 and the belt 68 for convenient explanation, the present invention is not limited thereto. That is to say, it will be appreciated by those skilled in the art that the present invention may be applied to a direct drive type in which the motor 70 is directly connected to a rear surface of the drum 20 such that the drum 20 only is rotated by the motor 70.

Now, the above mentioned constituent elements will be described in detail, respectively.

The cabinet 10, which defines the outer appearance of the drying machine, includes a base 12 forming a bottom wall of the cabinet 10, a pair of side covers 14 vertically erected from opposite sides of the base 12, a front cover 16 and a rear cover 18 installed, respectively, at the front and rear sides of the side covers 14, and a top cover 17 located at the upper side of the side covers 14. Conventionally, a control panel 19, which has a variety of operating switches, etc., is provided at the top cover 17 or the front cover 16. The front cover 16 is also provided with a door 164. The rear cover 18 is provided with a suction portion 182 for introduction of outside air into the drum 20 and an exhaust hole 184 that serves as a final passage for discharging the interior air of the drum 20 to the outside.

The interior space of the drum 20 functions as a drying chamber for drying a wet object. Preferably, the drum 20 incorporates, therein, lifters 22 for lifting, allowing free fall, and overturning the wet object to be dried, in order to increase the drying efficiency of the wet object.

Meanwhile, a front supporter 30 is installed between the drum 20 and the front cover 16 of the cabinet 10, and a rear supporter 40 is installed between the drum 20 and the rear cover 18 of the cabinet 10. The drum 20 is rotatably installed between the front supporter 30 and the rear supporter 40. Sealing members (not shown) are installed between the front supporter 30 and the drum 20 and between the rear support 40 and the drum 20, to prevent leakage of hot air. That is to say, the front supporter 30 and the rear supporter 40 serve to close front and rear surfaces of the drum 20 so as to define the drying chamber, and also, serve to support front and rear ends of the drum 20.

The front supporter 30 has an opening for accessing the drum 20 from the outside of the drying machine. The opening of the front supporter 30 is configured to be selectively opened and closed by the door 164. The front supporter 30 is connected to a lint duct 50. The lint duct 50 serves as a passage for directing the interior air of the drum 20 to the outside. The lint duct 50 incorporates therein a lint filter 52. The blower unit 60 is connected, at one side thereof, to the lint duct 50 and, at the other side thereof, to an exhaust duct 80. The exhaust duct 80 communicates with the exhaust hole 184 perforated in the rear cover 18. Accordingly, if the blower unit 60 is operated, the interior air of the drum 20 is discharged to the outside through the lint duct 50, the exhaust duct 80, and the exhaust hole 184 in this sequence. In this case, impurities, such as lint, etc., are filtered by the lint filter 52. Conventionally, the blower unit 60 includes a blower 62 and a blower housing 64. In general, the blower 62 is connected to the motor 70 that is used to drive the drum 20, so as to be operated by the motor 70.

Conventionally, the rear supporter 40 has a venting portion 42 formed with a plurality of vent holes. The venting portion 42 is connected to the hot air supply duct 44. The hot air supply duct 44 is configured to communicate with the drum 20, and serves as a passage for supplying hot air into the drum 20. Accordingly, the hot air supply duct 44 is provided with the hot air heater 90 at a predetermined position.

Figure 3:
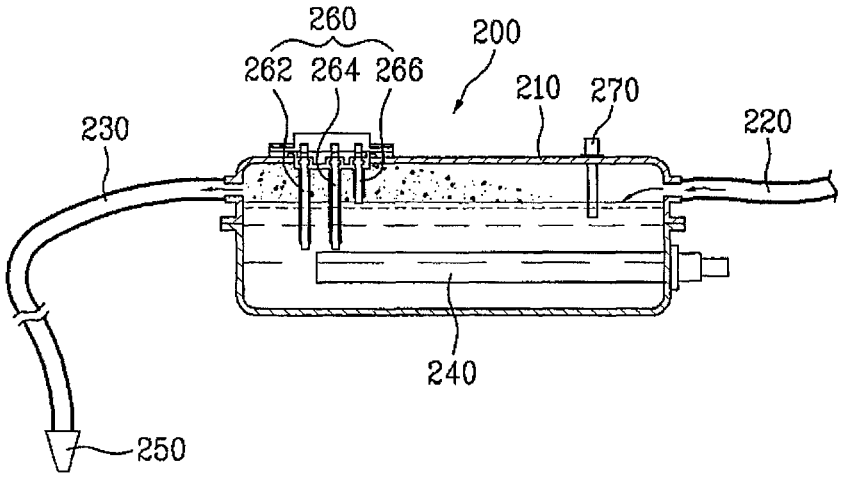
FIG. 3 is a sectional view illustrating a steam generator shown in FIG. 1.

Meanwhile, the steam generator 200 is installed in the cabinet 10 at a predetermined position. The steam generator 200 is adapted to generate steam and supply the steam into the drum 20. Now, the steam generator 200 will be described in detail with reference to FIG. 3.

The steam generator 200 includes a water tank 210 having a predetermined size for receiving water therein, a heater 240 mounted in the water tank 210, a water level sensor 260 for measuring the level of water received in the steam generator 200, and a temperature sensor 270 for measuring the temperature of the steam generator 200. The water level sensor 260 conventionally includes a common electrode 262, a low water level electrode 264, and a high water level electrode 266. If current is conducted between the common electrode 262 and the high water level electrode 264, a high water level is detected, and if current is conducted between the common electrode 262 and the low water level sensor 266, a low water level is detected.

A water supply hose 220 is connected to one side of the steam generator 200 for supplying water into the steam generator 200, and a steam hose 230 is connected to the other side of the steam generator 200 to constitute a steam supply member for discharging steam generated in the steam generator 200 into the drum 20. Preferably, a nozzle 250 having a predetermined shape is provided at a tip end of the steam hose 230. Conventionally, one end of the water supply hose 220 is connected to an external water supply source, such as a water tap. The tip end of the steam hose 230, or the nozzle 250, which defines a steam discharge port, is located in the drum 20 at a predetermined position, to inject steam into the drum 20.

Meanwhile, although the present embodiment illustrates and describes the steam generator 200 that is designed to heat a predetermined amount of water received in the water tank 210 by use of the heater 240 for generating steam, the present invention is not limited thereto. In the present invention, the steam generator may be replaced by any other device so long as the device can generate steam. For example, the heater may be directly coupled around the water supply hose such that water passing through the water supply hose can be heated in the water supply hose, rather than being received in a predetermined space for heating thereof (hereinafter, this water heating manner is referred to as "pipe heating manner" for convenient explanation).

Now, another embodiment of the drying machine according to the present invention will be described with reference to FIG. 4.

In the present embodiment, there is provided a detachable water supply source for supplying water into the steam generator 200. Although a water tap may be used as the water supply source in the same manner as the previously described embodiment, this has a problem of complex installation. Since it is general to supply no water into the drying machine, using the water tap as a water supply source needs installation of various incidental devices. Accordingly, it is expedient, like the present embodiment, that a detachable water supply source 300 be coupled to the drying machine only if necessary. The water supply source 300 is detachable from the drying machine, for charging water therein, and after being completely charged, is again connected to a water supply path of the steam generator 200, namely, to the water supply hose 220.

Preferably, a pump 400 is provided between the water supply source 300 and the steam generator 200. More preferably, the pump 400 is rotatable forward or reverse, and used to supply water into the steam generator 200. If necessary, the pump 40 is also used to collect water remaining in the steam generator 200. As will be appreciated by those skilled in the art, water may be supplied into the steam generator 200 by use of a water level difference between the water supply source 300 and the steam generator 200, without using the pump 400. However, various conventional constituent elements of the drying machine are standard products and have a compact design, and therefore, suffer from an absolute shortage in their structural space. Accordingly, in fact, supplying water only based on the water level difference is impossible so long as the various constituent elements of the drying machine do not vary in size. Accordingly, it can be said that the small-size pump 400 is available because it ensures easy installation of the steam generator 200, etc. without a change in the size of the various conventional elements of the drying machine. The reason for collecting the water remaining in the steam generator 200 is that there is a risk in that the heater 240 of the steam generator 200 may be damaged by the residual water when the steam generator 200 is not used for a long time, or that spoiled water may be used later in the generation of steam.

In addition, although the steam generator 200 of the previously described embodiment is designed to receive water and discharge steam through an upper end thereof, in the present embodiment, it is preferable that water be supplied through a lower end of the steam generator 200 and steam be discharged through the upper end of the steam generator 200. This configuration is advantageous to collect the water remaining in the steam generator 200.

Preferably, a steam discharge path of the steam generator 200, namely the steam hose 230, is provided with a safety valve 500.

Hereinafter, the above mentioned respective elements will be described in more detail.

Figure 5:
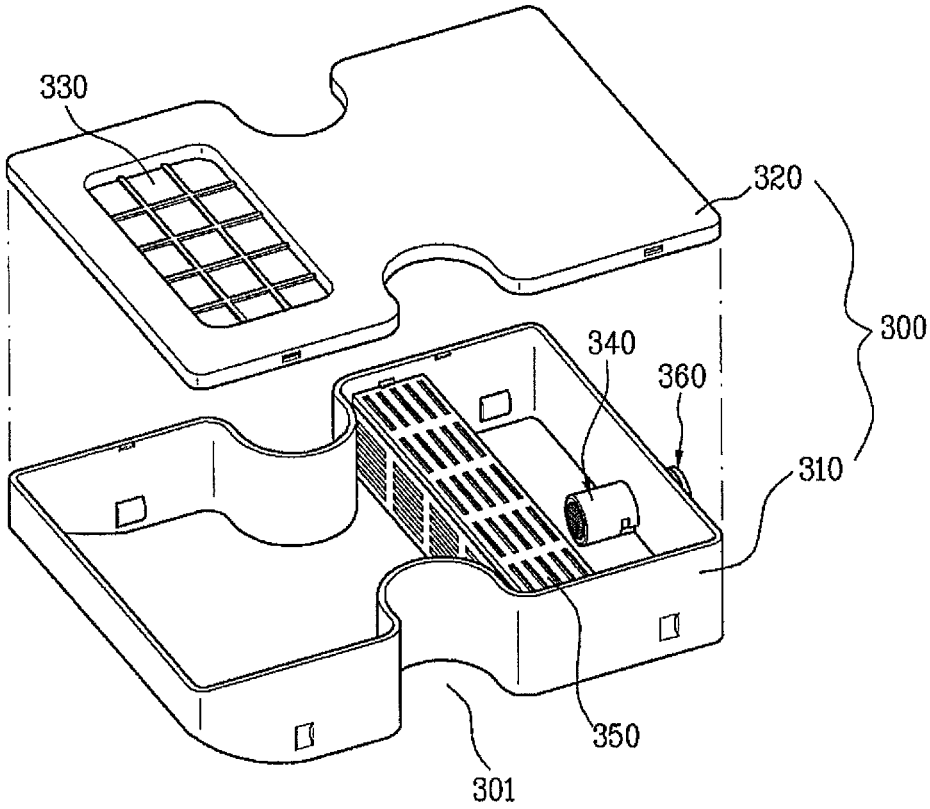
FIG. 5 is an exploded perspective view illustrating one example of a water supply source shown in FIG. 4.

First, the detachable water supply source 300 (hereinafter, referred to as "cartridge" for convenient explanation) will be described with reference to FIG. 5.

The cartridge 300 includes a lower housing 310 for receiving water, and an upper housing 320 configured to be detachably coupled to the lower housing 310. When the cartridge 300 is divided into the lower housing 310 and the upper housing 320, it is easy to clean debris, etc. accumulated in the cartridge 300, and to separate internal members of the cartridge 300, such as filters, water softening member, etc., for cleaning or regeneration of the internal members.

The upper housing 320 is preferably provided with a first filter 330. Specifically, the first filter 330 is mounted at a water inlet port of the upper housing 320 such that water is primarily filtered in the course of being supplied into the cartridge 300.

The lower housing 310 is provided with an opening/closing member 360 for selectively discharging water from the cartridge 300 to the outside. Preferably, the cartridge 300 is configured such that water within the cartridge 300 is not discharged to the outside when the cartridge 300 is separated from the steam generator 200, and discharged only when the cartridge 300 is coupled to the steam generator 200. The opening/closing member 360 is preferably connected to the second filter 340 for filtering water, and more preferably, the second filter 340 is detachably connected to the second filter 340. With the use of the first and second filters 330 and 340, it is possible to doubly filter impurities mixed in water, such as fine dust. Preferably, the first filter 330 is formed of a 50-mesh net, and the second filter 340 is formed of a 60-mesh net. Here, the term 50-mesh net means that the number of meshes per a predetermined area of a net is approximately 50. Accordingly, it will be appreciated that the size of pores forming the meshes of the first filter 330 is larger than the size of pores of the second filter 340, thus allowing the first filter 330 to be used to primarily filter large impurities, and the second filter 340 to be used to secondarily filter small impurities.

Figure 6:
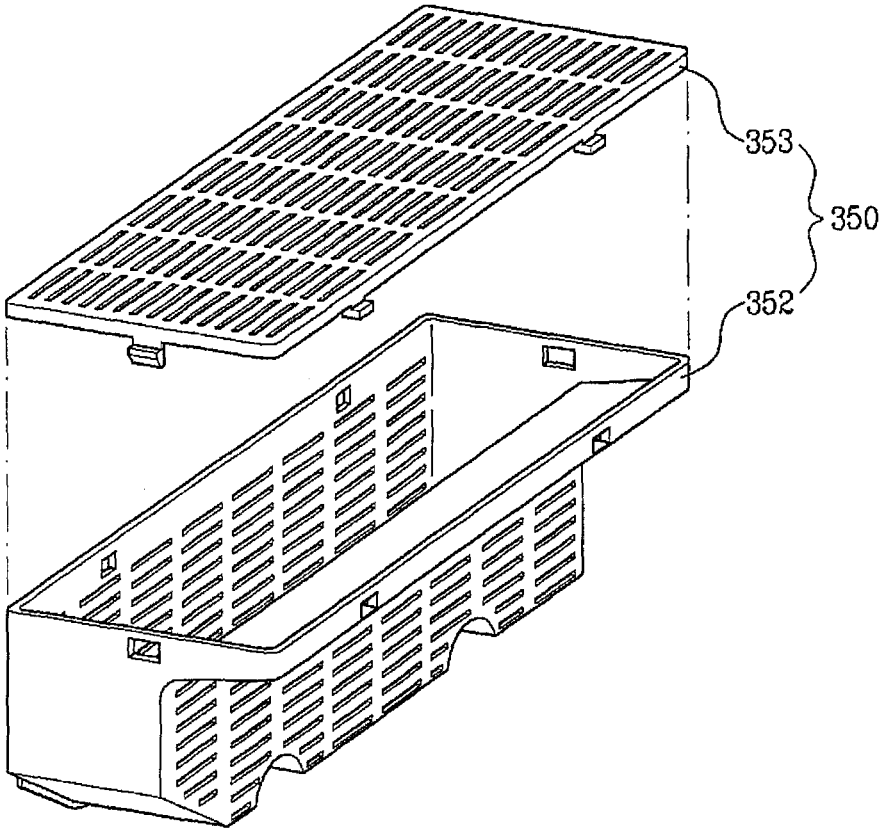
FIG. 6 is an exploded perspective view illustrating a water softening member shown in FIG. 5.

Preferably, a water softening member 350 is further provided in the cartridge 300, to soften the water within the cartridge 300. More preferably, the water softening member 350 has a detachable configuration. As shown in FIG. 6, the water softening member 350 includes a lower housing 352 having a plurality of through-holes, and an upper housing 353 having a plurality of through-holes, the upper housing 353 being detachably coupled to the lower housing 352. Preferably, ion exchange resin (not shown) is charged in a space defined between the upper housing 353 and the lower housing 352.

Now, the reason for using the water softening member 350 will be described. When water having a high hardness is supplied into the steam generator 200, lime (calcium carbonate ($CaCO_3$), etc.) may be precipitated from the water when calcium hydrogen carbonate ($Ca(HCO_3)_2$) dissolved in the water is heated. The lime may cause corrosion of the heater 240, etc. In particular, in the areas of Europe and U.S.A. using hard water with a high hardness, the corrosion of the heater 240 by the lime may be serious. Accordingly, it is preferable to previously remove calcium and magnesium ions, etc. using the ion exchange resin, so as to prevent precipitation of lime. Since the performance of the ion change resin gradually deteriorates as the softening of water proceeds, sodium chloride (NaCl) may be used to regenerate the ion exchange resin, so as to reuse the ion exchange resin. For reference, the water softening using the ion exchange resin is represented as 2(R—SONa)+Ca2<–>(R—SO)Ca+2 Na, and the regeneration is represented as (R—SO)Ca+2 NaCl<–>2(R—SONa)+CaCl.

Figure 7A:
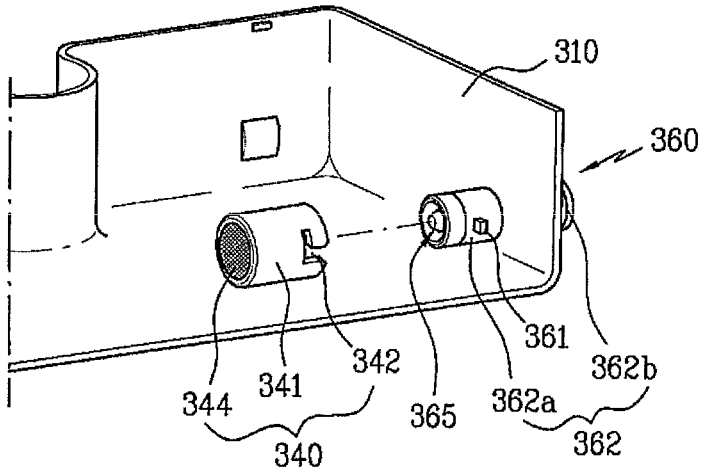
FIGS. 7A to 7C are partially cut-away perspective views of FIG. 5.
Figure 7B:
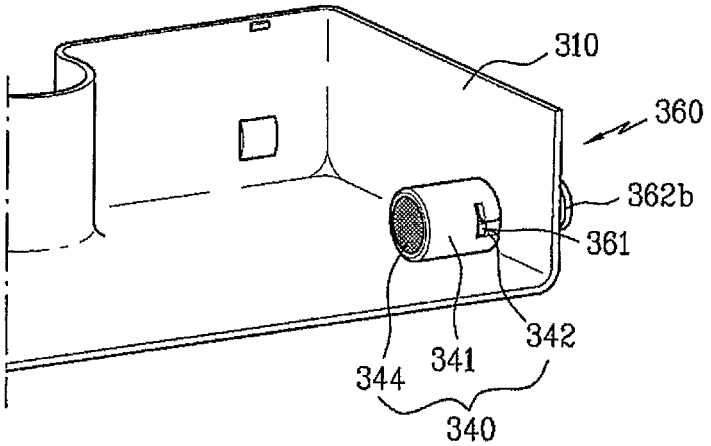
Figure 7C:
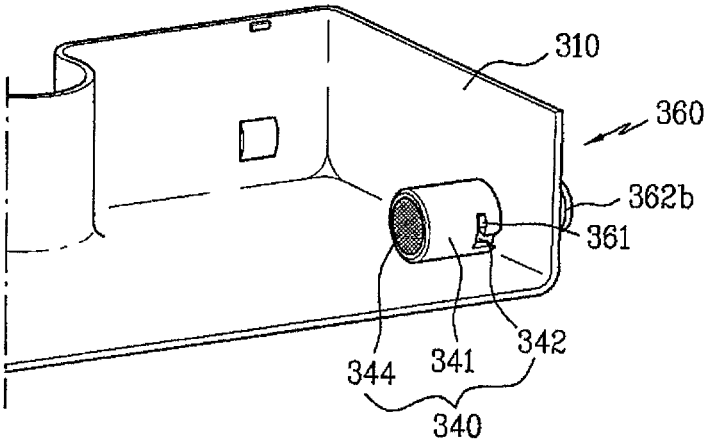

Now, an attachment/detachment structure of the second filter 340 and the opening/closing member 360 will be described in detail with reference to FIGS. 7A to 7C.

The lower housing 310 of the cartridge 300 is provided with the opening/closing member 360 communicating with the cartridge 300. The opening/closing member 360 includes a channel 362 communicating with the cartridge 300, and a pin 365 for selectively opening or closing the channel 362. The channel 362 is divided into an inner channel 362*a* and an outer channel 362*b*, and a holding protrusion 361 is formed at an outer surface of the inner channel 362*a*. The second filter 340 includes a case 341 having a shape corresponding to that of the inner channel 362*a*, and a filtering portion 344 is provided at one side of the case 341. The other side of the case 341 is provided with a slot 342. The slot 342 has a shape corresponding to that of the holding protrusion 361 of the inner channel 362*a*. The slot 342 has approximately a L-shaped form, and that is to say has a horizontal portion and a vertical portion. Accordingly, after the slot 342 of the second filter 340, more particularly the horizontal portion of the slot 342, is pushed to receive the holding protrusion 361 of the inner channel 362*a* therein as shown in FIG. 7B, the second filter 340 is turned as shown in FIG. 7C, thus completing the coupling of the second filter 340 with the opening/closing member 360. To separate the second filter 340 from the opening/closing member 360, the above described procedure is performed in reverse. Detailed description thereof will be omitted.

Next, referring to FIG. 8, the connecting relationship between the cartridge 300 and the pump 400 will be described in detail.

Figure 8:
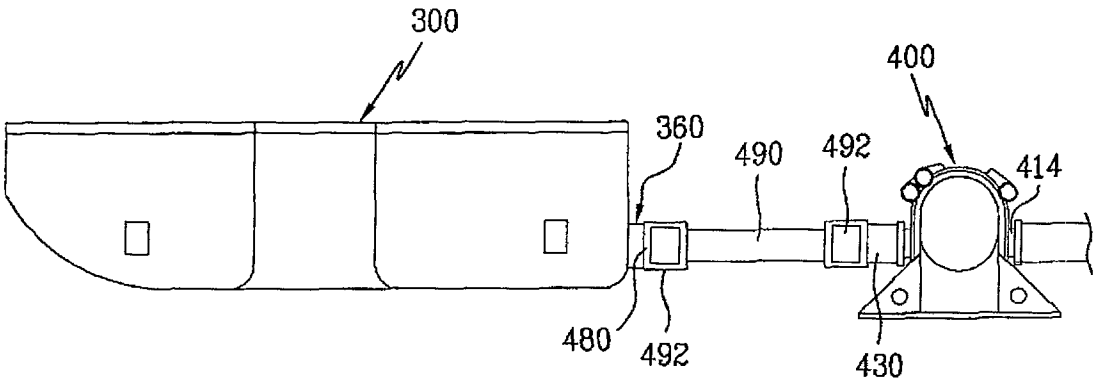
FIG. 8 is a side view illustrating the connecting structure of the water supply source and pump shown in FIG. 4.

As shown in FIG. 8, the cartridge 300 and the pump 400 are connected to each other by means of an intermediate hose 490. It is noted that one end of the intermediate hose 490 is directly connected to an inlet port 430 of the pump 400, but the other end of the intermediate hose 490 is connected to the cartridge 300 via a connector 480. Preferably, clamps 492 are provided, respectively, between the inlet port 430 of the pump 400 and the intermediate hose 490 and between the connector 480 and the intermediate hose 490, to prevent leakage of water.

Figure 9A:
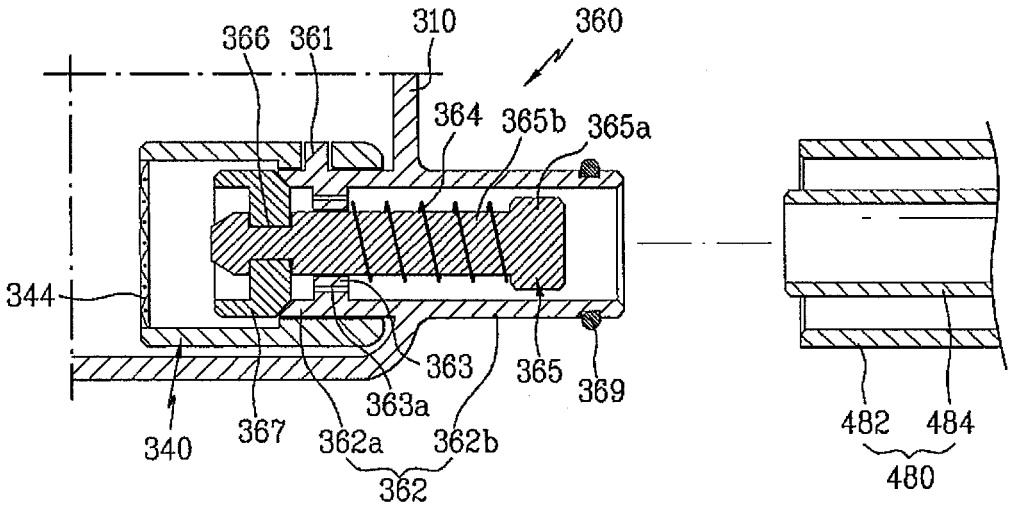
FIGS. 9A and 9B are sectional views illustrating the attachment/detachment relationship of the water supply source.
Figure 9B:
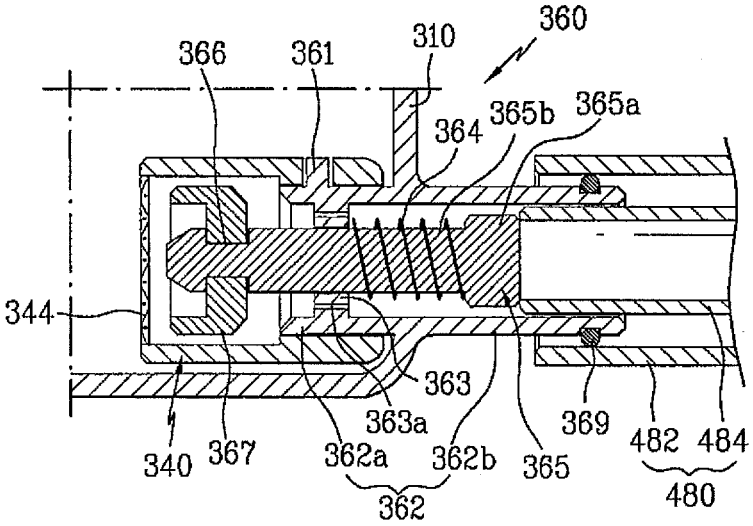
Figure 10:
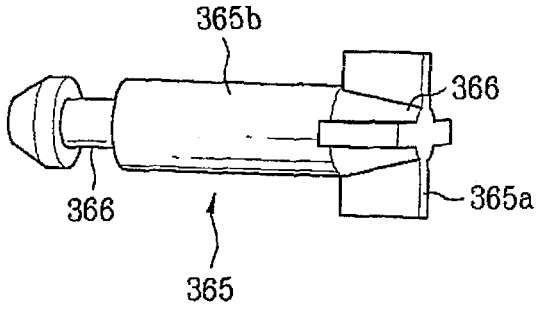
FIG. 10 is a perspective view illustrating an alternative embodiment of a pin shown in FIGS. 9A and 9B.

Referring to FIGS. 9A and 9B and 10, the connecting relationship between the cartridge 300 and the connector 480 will be described in more detail.

As described above, the cartridge 300 is provided with the opening/closing member 360 communicating with the cartridge 300. The opening/closing member 360 includes the channel 362 and the pin 365 for selectively opening or closing the channel 362. The channel 362 includes the inner channel 362*a* and the outer channel 362*b*, and an O-ring 369 is provided around an outer surface of the outer channel 362*b*, for the purpose of air-tightness.

Meanwhile, the pin 365 has a body portion 365*b*, a recessed portion 366 formed at one side of the body portion 365*b*, and a flowing portion 365*a* formed at the other side of the body portion 365*b* (See FIG. 10). A plug 367 is fitted around the recessed portion 366. The flowing portion 365*a* has an approximately crucial cross section such that water flows between blades arranged in a crucial form. The plug 367 is preferably made of a rubber material.

Considering the configuration of the channel 362 in more detail, the channel 362 has a supporting portion 363 for supporting the body portion 365*b* of the pin 365. The supporting portion 363 is formed with having a plurality of through-holes 363*a*. A spring 364 is provided between the supporting portion 363 and the flowing portion 365*a* of the pin 365. The connector 480 has an outer portion 482 having an inner diameter larger than an outer diameter of the outer channel 362*b* of the opening/closing member 360, and an inner portion 484 having an outer diameter smaller than the inner diameter of the outer channel 362*b*.

As shown in FIG. 9A, in a state wherein the cartridge 300 is separated from the connector 480, a tip end of the inner channel 362*a* is closed by the plug 367, mounted at one side of the pin 365, under operation of the spring 364. Thereby, the water within the cartridge 300 is not discharged to the outside through the channel 362. However, if the cartridge 300 is inserted into the connector 480 as shown in FIG. 9B, the pin 365 is pushed, inward of the inner channel 362*a*, by the inner portion 484 of the connector 480 while overcoming the elastic force of the spring 364. Thereby, the plug 367 provided at one side of the pin 365 is separated from the tip end of the inner channel 362*a*, thereby causing water to flow through a gap between the plug 367 and the tip end of the inner channel 362*a*. In this way, the water within the cartridge 300 is able to be discharged through the channel 360, more particularly, toward the pump 400. In the present invention, it is possible to efficiently prevent leakage of water by virtue of a double sealing structure using the spring 364 and the O-ring 369.

As shown in FIG. 10, the end of the pin 365, namely, the flowing portion 365*a* preferably has a tapered inner portion. This configuration increases the area of a water flow passage as compared to a cylindrical shape, to achieve more efficient flow of water.

Figure 11:
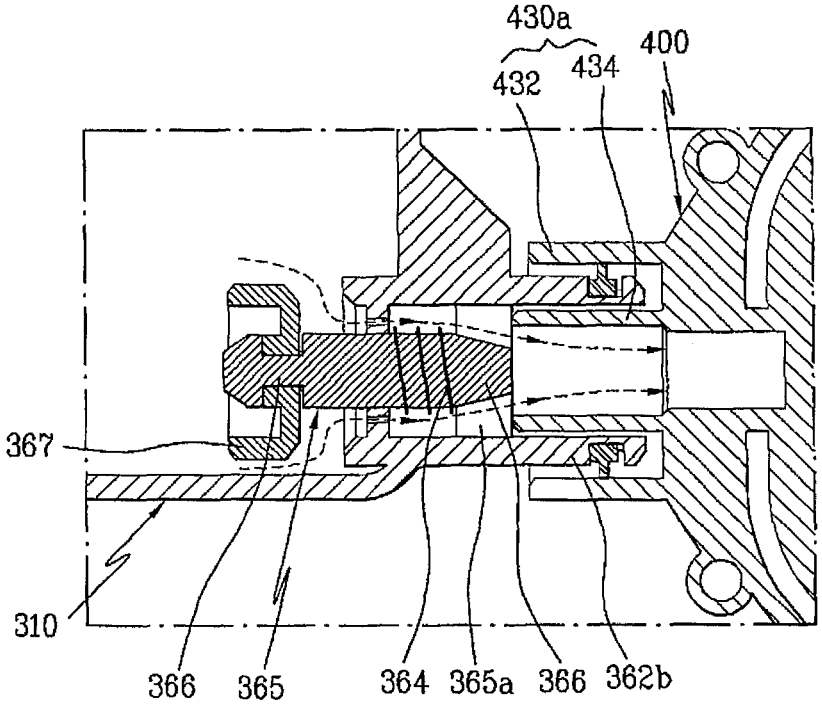
FIG. 11 is a sectional view illustrating another embodiment of the connecting structure of the water supply source and pump shown in FIG. 4.

Meanwhile, as shown in FIG. 11, the cartridge 300 may be directly connected to the pump 400 without using the intermediate hose 490. In this case, it is necessary to appropriately change the shape of an inlet port 430*a* of the pump 400. For example, the inlet port 430*a* may include an outer portion 432 and an inner portion 434. That is to say, the inlet port 430*a* of the pump 400 has a shape similar to that of the connector 480 shown in FIG. 9. As compared to the connecting structure shown in FIGS. 8 and 9, the above described configuration enables omission of the intermediate hose 490, sealing clamps 492, etc., and thus, has the advantage of reducing material costs and processing time.

Meanwhile, although the above described embodiment illustrates and describes the detachable cartridge 300 having the first filter 330, second filter 340, and water softening member 350, the present invention is not limited thereto. For example, the present invention is available in the case where a water tap is used as the water supply source. In this case, it is preferable that at least one of the first filter 330, second filter 340, and water softening member 350 be installed on a water supply path connected to the steam generator 200. More preferably, the first filter 330, second filter 340, and water softening member 350 are detachably installed on the water supply path. Also, the first filter 330, second filter 340, and water softening member 350 are preferably provided in a single container, and the container is detachably installed on the water supply path.

Figure 12:
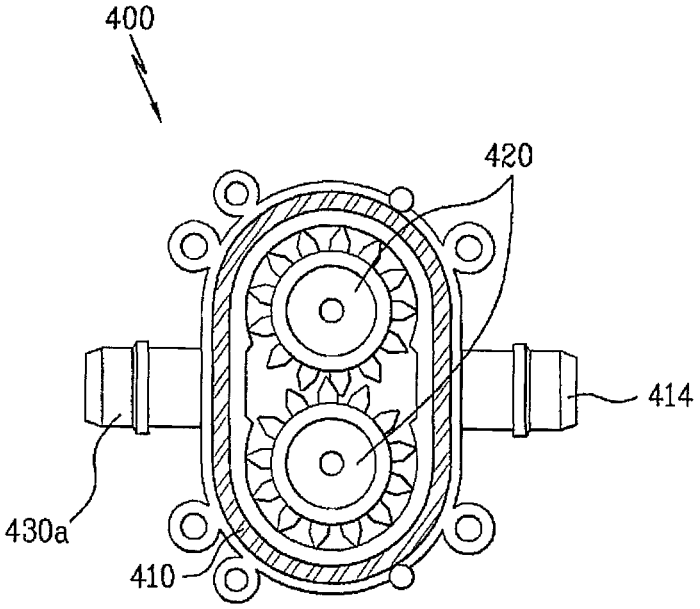
FIG. 12 is a sectional view schematically illustrating one example of the pump shown in FIG. 4.

Referring to FIG. 12, the pump 400 will be described hereinafter.

The pump 400 serves to selectively supply water into the steam generator 200. Preferably, the pump 400 is rotatable forward and reverse, and has the function of selectively supplying water into the steam generator 200 or collecting the water from the steam generator 200.

The pump 400 may be any one selected from gear type, pulsating type, diaphragm type pumps, etc. In the pulsating type and diaphragm type pumps, similarly, the flow of fluid can be controlled forward and reverse by changing the polarity of a circuit in every moment. FIG. 12 illustrates a gear type pump as one example of available pumps. The gear type pump 400 includes a case 410 having the inlet port 430*a* and an outlet port 414, and a pair of gears 420 received in the case 410. Depending on the rotating direction of the gears 420, water can flow from the inlet port 430*a* to the outlet port 414, or from the outlet port 414 to the inlet port 430*a*, to thereby be discharged to the outside.

Referring to FIGS. 13 to 17, the nozzle 250 will be described in detail.

Figure 13:
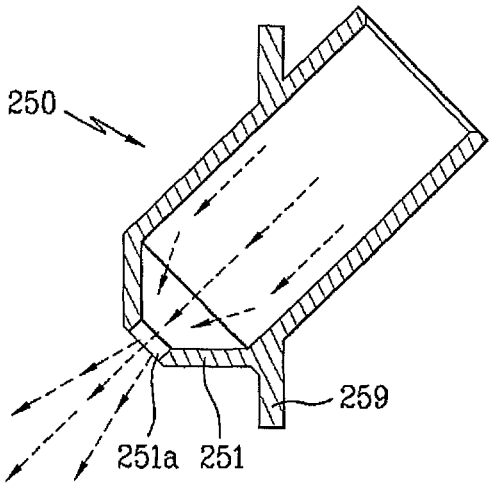
FIG. 13 is a sectional view illustrating one example of a nozzle shown in FIG. 4.

As shown in FIG. 13, the nozzle 250 may have a general shape. Specifically, the nozzle 250 takes the form of a cylindrical tubular shape having a tapered tip end portion 251. The tip end portion 251 of the nozzle 250 has an injection opening 251*a* such that steam is able to be injected into the drum 20 of the drying machine. Preferably, the nozzle 250 has a supporting portion 259 for the installation of the nozzle 250. However, when steam is simply ejected from the injection opening 251*a* formed in the tip end portion 251 of the nozzle 250 as shown in FIG. 13, the steam may be ejected only onto a small area of the drum 20 based on the kinetic energy of the steam, thus causing poor performance in de-wrinkling. Accordingly, it is preferable to appropriately change the shape of the nozzle 250, etc.

Figure 14:
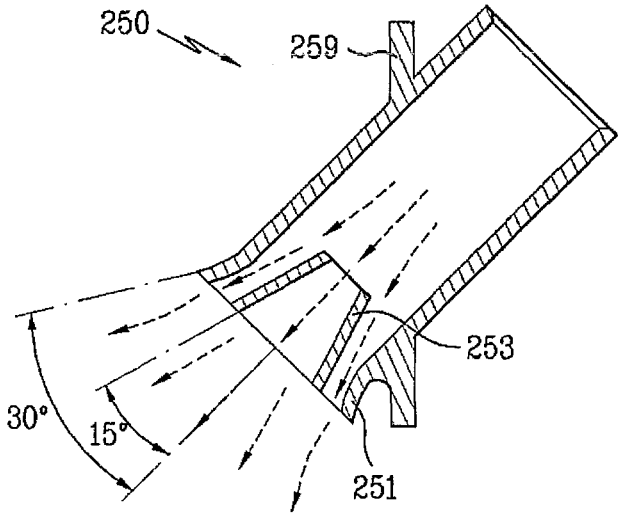
FIGS. 14 and 15 are a sectional view and a perspective view, respectively, illustrating another example of the nozzle shown in FIG. 4.
Figure 15:
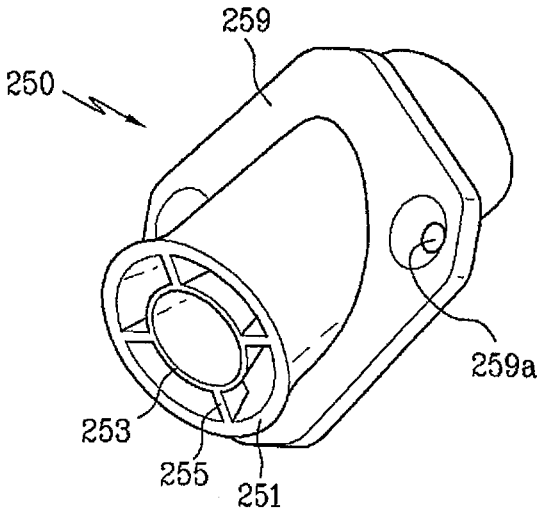

Referring to FIGS. 14 and 15, another example of the nozzle 250 will now be described.

Preferably, an auxiliary nozzle 253 is provided in the nozzle 250, which is connected to the steam generator 200 and adapted to supply steam into the drum 20. In this case, the nozzle 250 preferably has a constant-diameter cylindrical shape or a partially tapered cylindrical shape. When the nozzle 250 has a partially tapered cylindrical shape, preferably, the tip end portion 251 of the nozzle 250 has a slightly increased diameter. The auxiliary nozzle 253 preferably has a tapered shape or cone shape. Also, it is preferable that an outwardly tapered angle of the nozzle 250 is larger than an outwardly tapered angle of the auxiliary nozzle 253. For example, the outwardly tapered angle of the nozzle 250 is 30 degrees, and the outwardly tapered angle of the auxiliary nozzle 253 is 15 degrees.

With the above described configuration, it is possible to increase the diffusion angle of the steam, thereby allowing steam to be uniformly ejected onto clothes, and consequently, achieving an improved performance in de-wrinkling.

More preferably, the nozzle 250 and the auxiliary nozzle 253 are connected to each other by means of a connector 255. With this configuration, the nozzle 250, auxiliary nozzle 253, and connector 255 can be integrally formed with one another, and this results in an improvement in the formability, mass productivity, etc. of a mold.

In FIG. 15, not aforementioned reference numeral 259*a* denotes a coupling hole formed in the supporting portion 259.

Figure 16:
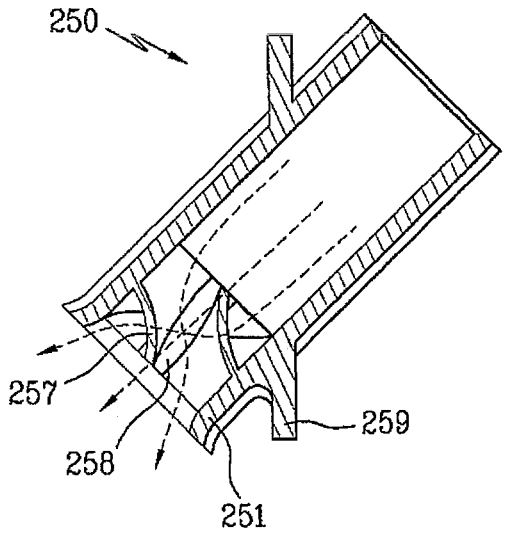
FIGS. 16 and 17 are a sectional view and a perspective view, respectively, illustrating yet another example of the nozzle shown in FIG. 4.
Figure 17:
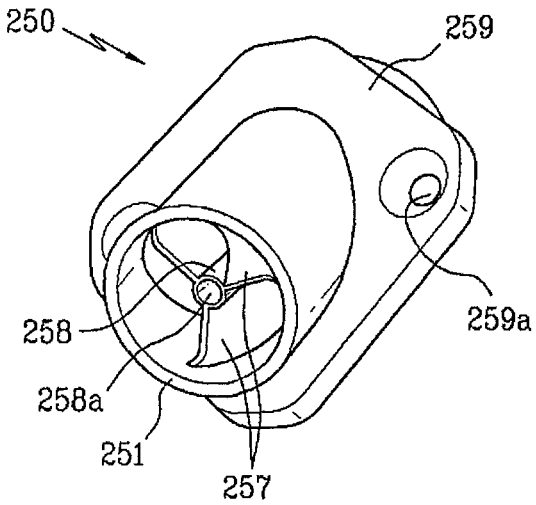

Referring to FIGS. 16 and 17, yet another example of the nozzle 250 will be described.

Preferably, a swirl generating member is provided in the nozzle 250, to generate a steam swirl. Similar to the above described examples, the nozzle 250 has a constant diameter cylindrical shape or a partially tapered cylindrical shape. When the nozzle 250 has the partially tapered cylindrical shape, preferably, the tip end portion 251 of the nozzle 250 has a slightly increased diameter.

The swirl generating member preferably includes one or more blades 257. The blades 257 extend from an inner wall of the nozzle 250 to the center of the nozzle 250, and preferably, have a curved surface. In this case, the plurality of blades 257 are connected to one another at the center of the nozzle 250, and more preferably, a center member 258 is provided in the nozzle 250 such that the blades 257 are located between the inner wall of the nozzle 250 and the center member 258. More preferably, the center member 258 has a flow path 258*a* therein. This configuration is efficient to improve the formability, mass productivity, etc. of a mold.

With the above described configuration, by allowing the steam to flow in the form of a swirl, it is possible to increase the kinetic energy and diffusion angle of the steam. As a result, the steam can be uniformly spread over clothes, thereby achieving an improved performance in de-wrinkling.

Figure 24:
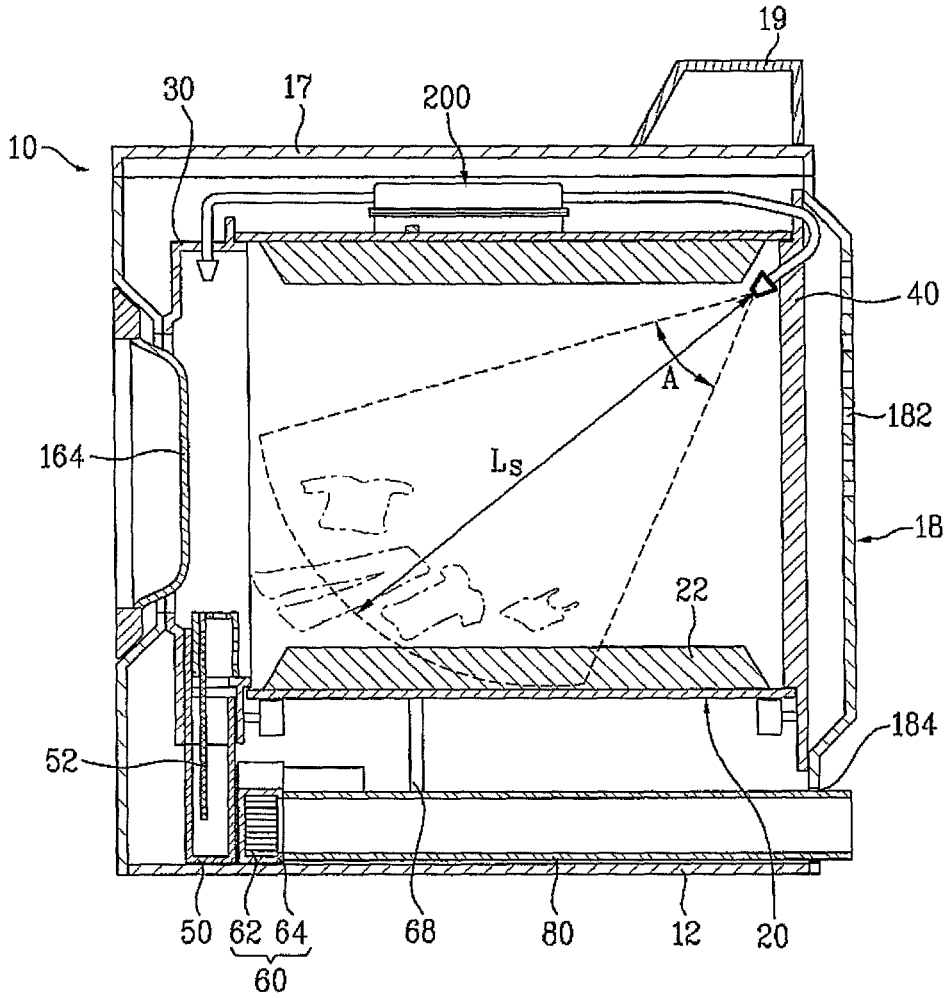
FIG. 24 is a longitudinal view of FIG. 1.

Meanwhile, with the study by the inventors of the present invention, when the steam is injected into the drum 20, the injection angle and injection distance of the steam have an effect on the performance in de-wrinkling. This will be described hereinafter in more detail with reference to FIGS. 24 and 25.

The greater the steam injection angle A and the steam injection distance Ls, steam can be uniformly absorbed into an object to be dried, resulting in an improved performance in de-wrinkling of the drying machine. Here, it is noted that the steam injection angle A and the injection distance Ls are determined depending on the tapered angle B of the nozzle 250 and the diameter d and length l of an ejection opening 252. For example, the greater the diameter d of the ejection opening 252, the steam injection angle A is increased and the steam injection distance Ls is reduced. Accordingly, on the basis of experimental or calculative results, the tapered angle B of the nozzle 250 and the diameter d and length l of the ejection opening 252 may be determined to achieve the optimum steam injection angle A and steam injection distance Ls. However, there is a limit in the regulation of the steam injection angle A and the steam injection distance Ls by using the tapered angle B of the nozzle 250 and the diameter d and length l of the ejection opening 252. Accordingly, in one embodiment of the present invention, a swirler 300*a* as a swirl generating member may be installed in the steam supply member 230. With the study of the inventors, providing the swirler 300*a* has the effect of increasing the steam injection angle A.

Figure 26:
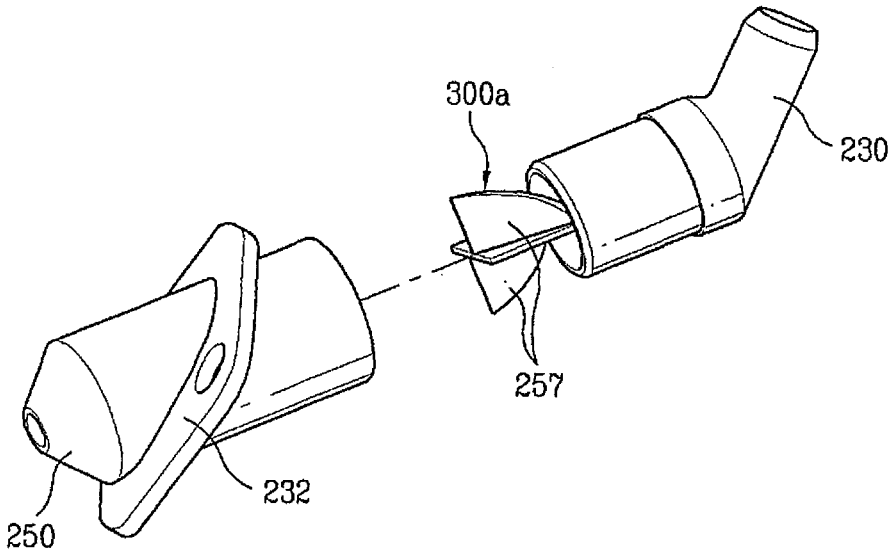
FIG. 26 is an exploded perspective view of FIG. 25.
Figure 27:
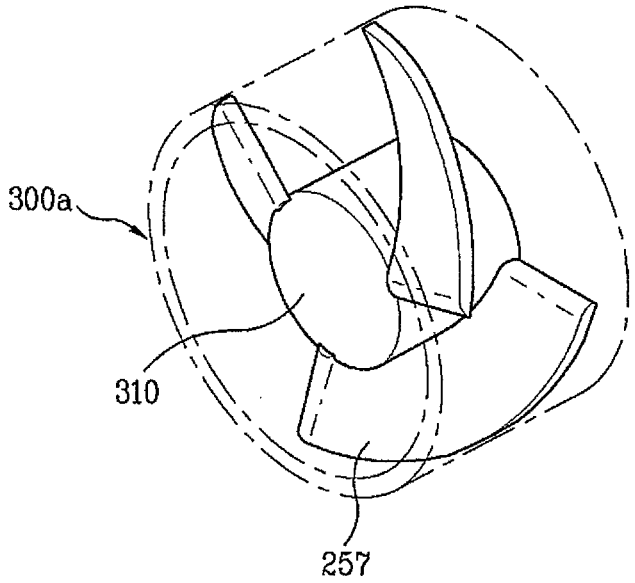
FIG. 27 is a perspective view illustrating an alternative example of a swirler shown in FIG. 26.

Referring to FIGS. 26 and 27, the swirler 300*a* according to the present invention will now be described in detail.

As described above, preferably, the nozzle 250 is provided at the tip end of the steam supply member 230 and has a partially tapered cylindrical shape. Preferably, the swirler 300*a* is located adjacent to the tip end of the steam supply member 230, that is to say, located behind the nozzle 250. The swirler 300*a* has the function of swirling the steam flowing through the steam supply member 230, to generate a steam swirl. The kind of the swirler 300*a* is not specially limited so long as it fulfills the above function. For example, as shown in FIG. 26, the swirler 300*a* may include one or more blades 257 for guiding the flow of air in the form of a swirl. The blades 257 preferably extend from the center of flow, namely, from the center of the steam supply member 230 to the inner wall of the steam supply member 230 and are tapered by a predetermined angle with respect to the flow direction of steam. Each of the blades 257 may have a plane shape as shown in FIG. 26, or a curved shape as shown in FIG. 27.

Also, the plurality of blades 257 may be directly connected to one another as shown in FIG. 26, or connected to one another by interposing a boss 310 therebetween. Here, the boss 310 serves as a center shaft of the plurality of blades 257.

Figure 28:
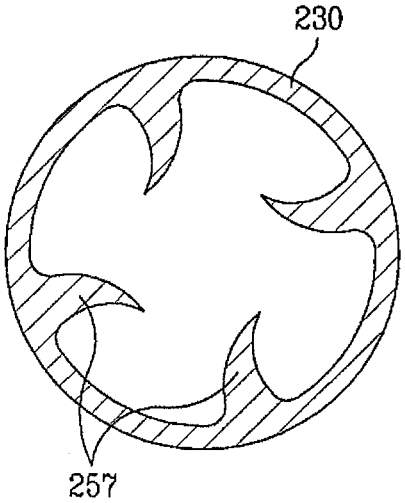
FIG. 28 is a sectional view schematically illustrating another alternative example of the swirler shown in FIG. 26.

As shown in FIG. 28, the blades 257 are formed at the inner wall of the steam supply member 230, to extend toward the center of the steam supply member 230. In this case, the blades 257 may be integrally formed with the steam supply member 230. With this integral configuration, for example, the steam supply member 230 and the blades 257 may be formed by injection molding, and this results in an improvement in the convenience of manufacture.

The shape, angle, etc. of the blades 257 may be appropriately selected in consideration of the flow of steam, and thus, detailed description thereof will be omitted herein.

Preferably, a supporting member 232 is provided at a tip end of the steam supply member 230, to assist the tip end of the steam supply member 230 to be installed to the drum 20. By regulating the angle of the supporting member 232 with respect to the steam supply member 230, it is possible to regulate the installation angle of the tip end of the steam supply member 230, more particularly, the installation angle of the nozzle 250 with respect to the drum 20.

Figure 25:
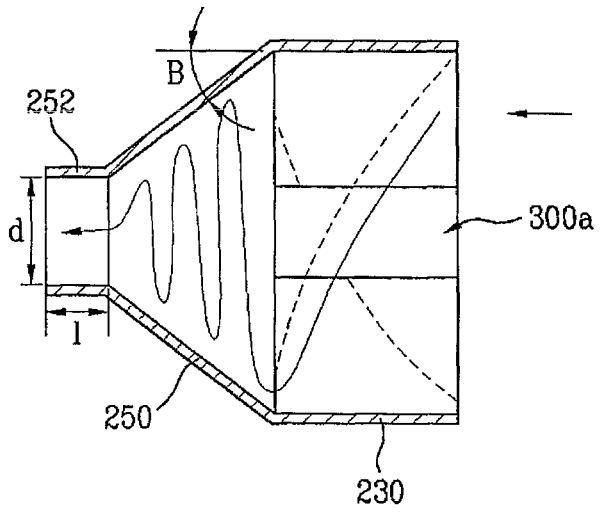
FIG. 25 is a sectional view schematically illustrating a steam supply portion of the steam generator shown in FIG. 1, which is given to explain the operating principle of the present invention.

If the swirler 300*a* is installed as shown in FIG. 25, steam flowing through the steam supply member 230 is swirled while passing through the swirler 300*a*, thereby allowing a steam swirl to be introduced into the nozzle 250. As compared to the absence of the swirler 300*a*, accordingly, the present invention has the effects of increasing the injection angle A of steam being injected onto the drum 20, and consequently, achieving an improved performance in de-wrinkling.

Figure 18:
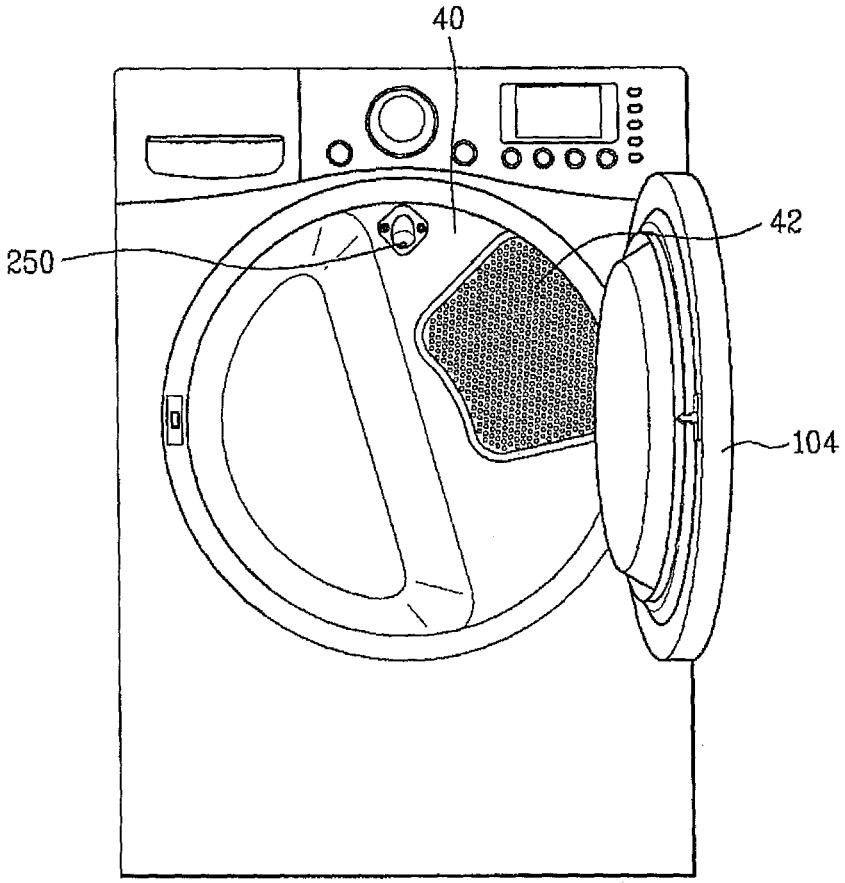
FIG. 18 is a front view illustrating an installation example of the nozzle shown in FIG. 4.

Meanwhile, as shown in FIG. 18, the nozzle 250 is preferably installed adjacent to the venting portion 42 that supplies hot air into the drum 20, such that steam can be injected from a rear surface to a front surface of the drum 20. This is because air is conventionally introduced into the drum 20 from the venting portion 42 of the rear supporter 40, and discharged from the drum 20 through the lint duct (not shown, See. FIG. 1) located below the door 104, to define an air flow path extending from the venting portion 42 to the lint duct. Accordingly, installing the nozzle 250 adjacent to the venting portion 42 allows the injected steam to flow efficiently along the air flow path, so as to be uniformly spread over clothes.

The above described nozzle 250 according to the present embodiment is available in other drying machines having no detachable water supply source 300. For example, the nozzle 250 is available when an exterior water tap is used as the water supply source 300.

Figure 4:
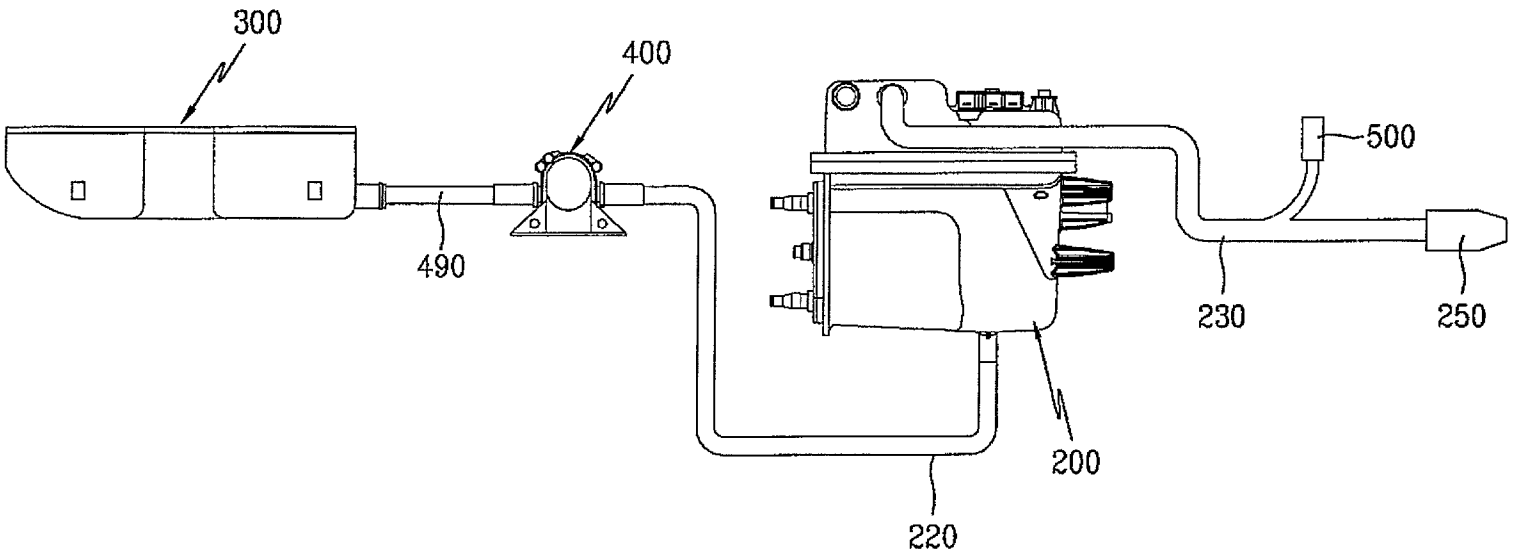
FIG. 4 is a schematic view illustrating another exemplary embodiment of the drying machine according to the present invention, which centers around the steam generator.

Referring to FIGS. 4 and 19, hereinafter, the safety valve 500 will be described in detail.

During normal operation of the steam generator 200, steam is injected into the drum 20 through the steam hose 230 and the nozzle 250. However, if fine fibrous particles, such as lint, impurities, etc., generated in the course of drying clothes, are attached to and accumulated in the injection opening 251*a* of the nozzle 250 and thus, the injection opening 251*a* is clogged, steam cannot be smoothly discharged into the drum 20 and is affected by a back pressure. This increases the internal pressure of the steam generator 200, thus having the possibility of damage to the steam generator 200, etc. In particular, in the drum heating type steam generator, the water tank of the steam generator is conventionally not designed as a high-pressure resistant container and thus, there exists a high risk of damage. Accordingly, it is preferable to provide the steam generator 200 with an appropriate safety device.

If the flow path of the steam generated within the steam generator is closed, the safety valve 500 serves to discharge the steam to the outside. For this, the safety valve 500 is preferably provided in the flow path of the steam, for example, in the steam hose 230. More preferably, the safety valve 500 is provided near the tip end of the steam hose 230, for example, provided adjacent to the nozzle 250.

The safety valve 500 includes a case 510 having one end communicating with the steam hose 230 and the other side communicating with the outside, and an opening/closing piece 530 disposed in the case 510 and adapted to selectively open or close the case 510 with respect to the steam hose 230. The opening/closing piece 530 is installed in a steam flow path communicating portion 513 of the case 510. The opening/closing piece 530 is supported by a spring 520. Of course, one end of the spring 520 is supported by the opening/closing piece 530, and the other end of the spring 520 is supported by a fixture 540 that is secured to the case 510 in a certain manner.

Figure 19A:
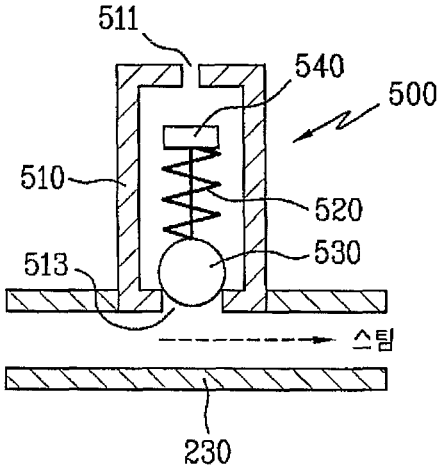
FIGS. 19A and 19B are sectional views schematically illustrating one example of a safety valve shown in FIG. 4.
Figure 19B:
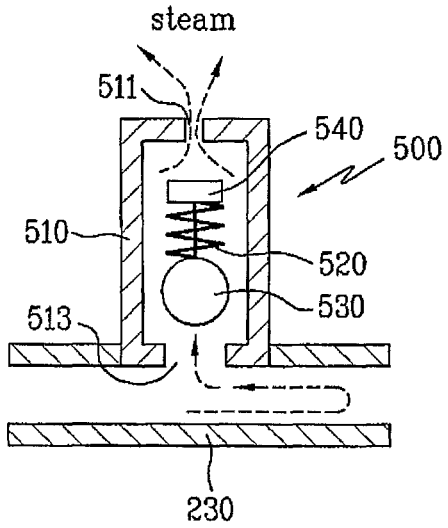

As shown in FIG. 19A, if the steam hose 230 is not closed and the pressure of the steam hose 230 is less than a predetermined pressure, steam flowing through the steam hose 230 cannot overcome the elastic force of the spring 520. Accordingly, the steam flow path communicating portion 513 is closed by the opening/closing piece 530, and thus, the steam is not discharged to the outside. However, as shown in FIG. 19B, if the steam hose 230 is closed and the pressure of the steam hose 230 is increased beyond a predetermined pressure, for example, a pressure of 1 kgf/cm$^2$, the steam overcomes the elastic force of the spring 520, thereby moving the opening/closing piece 530 from the steam flow path communicating portion 513. As a result, the steam is able to be discharged to the outside through the steam flow path communicating portion 513 and an outside communicating hole 511 formed in the case 510.

Figure 20:
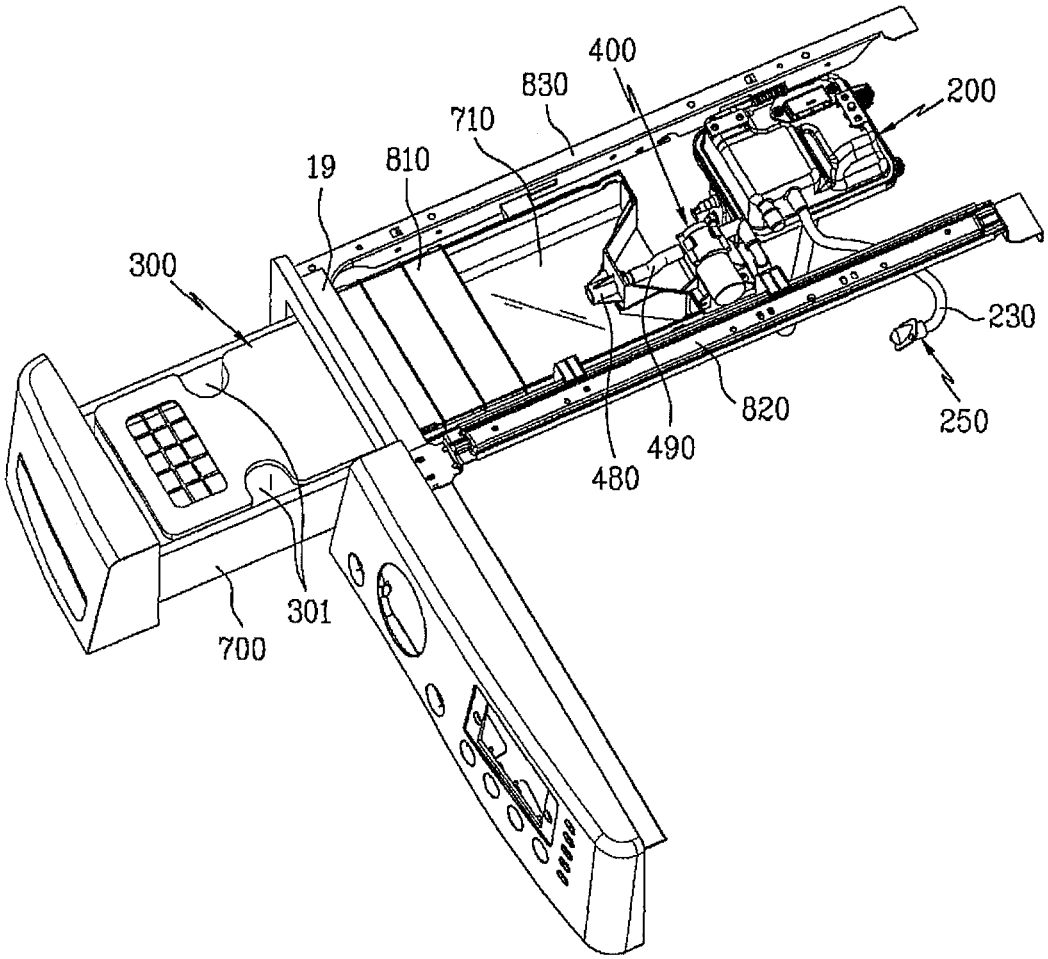
FIG. 20 is a perspective view illustrating an installation example of constituent elements shown in FIG. 4.

Referring to FIG. 20, a preferred embodiment related to installation positions of the above described constituent elements of a steam line, which centers around the steam generator according to the present invention, will be described hereinafter.

A drawer type container 700 (hereinafter, referred to as "drawer") is installed in the drying machine at a predetermined position, so as to be pulled out or taken into the drying machine. Preferably, the cartridge 300 is mounted in the drawer 700. That is to say, preferably, the cartridge 300 is mounted in the drawer 700 rather than being directly connected to the connector 480, such that the cartridge 300 can be indirectly coupled to or separated from the connector 480 as the drawer 700 is taken into or pulled out.

Preferably, the drawer 700 is provided at a front surface of the drying machine, for example, at the control panel 19. More specifically, a supporter 820 and a top frame 830 are installed to a rear surface of the control panel 19 such that the supporter 820 and the top frame 830 are arranged approximately parallel to each other. Preferably, a drawer guide 710 is installed between the supporter 820 and the top frame 830 and adapted to guide and support the drawer 700. More preferably, a top guide 810 is provided at a part of the upper portion of the drawer guide 710.

The drawer guide 710 has an opened upper surface and an opened side surface (facing the front side of the drying machine). Preferably, the drawer 700 is taken into or pulled out from the drawer guide 710 through the opened the side surface of the drawer guide 710. In this case, the connector 480 is preferably provided at an upper end of an opposite side surface of the drawer guide 710.

As described above, it is preferable to install the drawer 700 at the front surface of the drying machine, for convenience. On the basis of FIG. 20 illustrating the drying machine in which the control panel 19 is installed to the front cover 16 of the cabinet 10, the drawer 700 is taken into or pulled out of the control panel 19 as stated above, but the present invention is not limited to the above description. For example, in the case where the control panel is installed to the top cover of the cabinet as shown in FIG. 1, the drawer 700 may be directly installed to the front cover.

Meanwhile, when the cartridge 300 is mounted in the drawer 700, preferably, at least opposite side surfaces of the cartridge 300 have a shape corresponding to that of opposite side surfaces of the drawer 700, to achieve close coupling of the cartridge 300 and the drawer 700. To achieve detachable coupling of the cartridge 300, preferably, the cartridge 300 has finger recesses 301 formed at both the side surfaces thereof for use in the coupling or separation of the cartridge 300.

Hereinafter, a water filling manner of the cartridge 300 will be described with reference to FIG. 20.

If a user pulls out the drawer 700, the cartridge 300 is simultaneously pulled out. In this state, the cartridge 300 is manually separated from the drawer 700, and the user is able to supply water into the separated cartridge 300 through the water inlet port, for example, through the first filter 330 until the cartridge 300 is filled with the water. After the cartridge 300 is filled with the water, the cartridge 300 is again mounted into the drawer 700. If the drawer 700 is pushed into the drying machine, the cartridge 300 is automatically coupled to the connector 480, thereby being opened to allow the water of the cartridge 300 to flow toward the pump 400.

After the drying machine is completely used, the cartridge 300 can be separated from the drawer 700 in the reverse order of the above description. In the present invention, since the cartridge 300 is divided into the upper housing 320 and the lower housing 310, it is easy to clean the separated cartridge 300.

Figure 21:
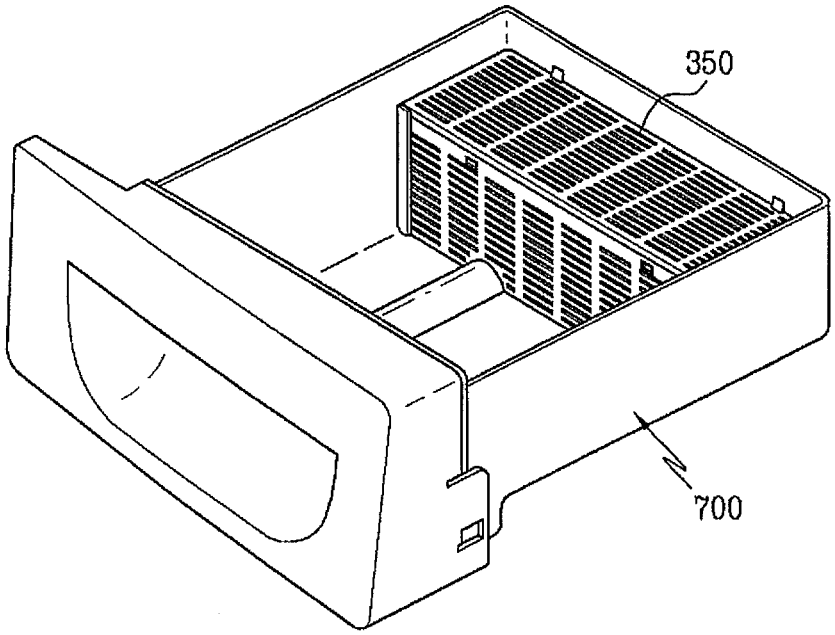
FIG. 21 is a perspective view illustrating another example of the water supply source shown in FIG. 4.

Meanwhile, as shown in FIG. 21, the drawer 700 can be used as a detachable water supply source. However, in this case, there is a risk in that water being supplied into the drawer 700 may overflow due to user error. For this reason, it is more preferable to use the cartridge 300 as the detachable water supply source. Using the drawer 700 as the detachable water supply source has an advantage of simplifying the structure of the water supply source. Although FIG. 21 illustrates that only the water softening member 350 is installed in the drawer 700 for convenient illustration, the present invention is not limited thereto, and of course, the first and second filters 330 and 340 may be installed in the drawer 700.

Hereinafter, a method for controlling the drying machine according to the present invention will be described with reference to FIGS. 22 and 23.

The method for controlling the drying machine according to the present invention comprises: a drum heating step SS3 for heating the drum; a steam supply step SS5 for supplying steam generated from the steam generator into the drum; and a hot air supply step SS7 for supplying hot air into the drum. Preferably, prior to the drum heating step SS3, a water supply step SS1 is performed, and a cooling step SS9 for cooling the drum is performed after the hot air supply step SS7. In addition, preferably, after completing the steam supply step SS5, a water withdrawal step for discharging water remaining in the steam generator, namely, the residual water is further performed (detailed description of the water withdrawal step will be followed). Although heating of the drum may be performed by a separate heater mounted in the drum, use of a hot air heater is more expedient.

Hereinafter, each control step will be described in detail.

In the drum heating step SS3, the drum is heated up to a predetermined temperature, to increase the effect of de-wrinkling that is mainly performed in the following steam supply step SS5. The drum heating step SS3 is performed for a predetermined time T_pre~T_pump. In this case, it is preferable to tumble the drum. The drum may be intermittently tumbled. Tumbling is an operation rotating the drum at a speed of approximately 50 rpm or less. Such tumbling of the drum is well known by those skilled in the art, and detailed description thereof will be omitted. It is preferable to begin the drum heating step SS3 at a time point when water within the steam generator reaches a high level as a result of being supplied for a predetermined time T_pump. Also, it is preferable to operate the steam heater at the beginning time point of the drum heating step SS3. This is because steam is able to be generated after the lapse of a predetermined time even after the operation of the steam heater begins. Preferably, the completion time point of the drum heating step SS3 approximately coincides with a steam generating time point.

The steam supply step SS5 is the step for performing a de-wrinkling function by supplying steam into the drum. The steam supply step SS5 is performed for a predetermined time T_steam. In this case, it is preferable to tumble the drum, and more preferably, to intermittently tumble the drum. Preferably, the continuation time T_steam of the steam supply step SS5 is preset by an experiment, etc. on the basis of factors, such as the amount of an object to be dried, etc. Since the level of water within the steam generator is lowered as the steam supply step SS5 proceeds, it is preferable to supply water if a low water level is detected. In this case, although water can be continuously supplied until a high water level is detected, in view of a heating efficiency, it is preferable to supply water only for a predetermined time, for example, for approximately three seconds, until the water reaches the high water level. During the steam supply step SS5, preferably, tumbling of the drum is intermittently and periodically repeated, for example, by an interval of approximately three seconds per one minute.

The hot air supply step SS7 is the step for supplying hot air generated by the hot air heater into the drum, to secondarily dry clothes that may be slightly moistened by the steam. The hot air supply step SS7 is performed for a predetermined time T_dry. During the hot air supply step SS7, it is preferable to not tumble the drum. The continuation time T_dry of the hot air supply step SS7 is preferably preset by an experiment, etc. on the basis of factors, such as the amount of the object to be dried, etc. After completing the hot air supply step SS7, it is preferable to discharge the water remaining in the steam generator into the cartridge. In this case, since the water remaining in the steam generator has a high temperature, it is preferable to delay the discharge of the residual water for a predetermined time T_delay rather than immediately discharging the water, and to discharge the water after the temperature of the steam generator is less than a predetermined temperature Temp_crit (detailed description thereof will be followed).

The cooling step SS9 is the step for cooling the dried object, which has a high temperature while passing through the hot air supply step SS7. The cooling step SS9 is performed for a predetermined time T_cooling. During the cooling step SS9, it is preferable to not tumble the drum. The continuation time T_cooling of the cooling step SS9 is preferably preset by an experiment, etc. on the basis of factors such as the amount of the object to be dried, etc. Although the cooling step SS9 is performed by supplying cool air into the drum, it is more simple to leave the dried object for a predetermined time in consideration of the fact the dried object has a relatively high temperature.

Now, referring to FIGS. 22 and 23, a pump control method will be described.

The pump control method according to the present invention comprises: a water supply step S100 and S200 for supplying water into the steam generator that generates steam to be supplied into the drum; and a water withdrawal step S300 for collecting the water remaining in the steam generator. Of course, the water supply step preferably includes an initial supply step S100 and a water level maintaining step S200 for maintaining the level of water within the steam generator. Meanwhile, the water withdrawal step S300 is preferably performed by the pump, and more preferably, water is withdrawn into the detachable water supply source connected to the steam generator.

Hereinafter, each step of the pump control method will be described.

As stated above, the water supply step S100 and S200 preferably includes the initial supply step S100 and the water level maintaining step S200 for maintaining the level of water within the steam generator. In the initial supply step S100, first, the pump is rotated forward, to supply water into the steam generator (Si). If the water within the steam generator reaches a high level (S3), preferably, the operation of the pump stops and the steam heater is operated (S5).

As the steam heater is operated, the water is heated, thus generating steam. In this case, the level of water within the steam generator is lowered as the generated steam is discharged into the drum. Accordingly, the level of water within the steam generator is continuously detected such that the pump is again rotated forward if a low water level is detected, to supply water into the steam generator (S9 and S11). In this case, as stated above, although water can be continuously supplied until a high water level is detected, it is preferable to supply water for a predetermined time, for example, for approximately three seconds, for the sake of a high heating efficiency.

Meanwhile, after the preset steam supply time T_steam is passed (S7), the steam heater is stopped (S13), and the discharge of the residual water within the steam generator is delayed for a predetermined time T_delay (S15). The reason for delaying the discharge of the residual water for the predetermined time T_delay is to lower the temperature of the residual water remaining in the steam generator to the maximum extent. Then, if the temperature of the steam generator is less than a safety temperature Temp_crit (S17), the pump is rotated reverse for a predetermined time, for example, for approximately thirty seconds, to withdraw the water remaining in the steam generator (S25). However, the temperature of the steam generator is higher than the safety temperature Temp_crit, a certain safety measure is taken without immediately withdrawing the residual water within the steam generator. For example, it is determined whether or not the water level of the steam generator is lower than a predetermined high water level (S19). If the water level of the steam generator is lower than the predetermined high water level, the pump is rotated forward for a predetermined time, for example, approximately five seconds, to supply water into the steam generator (S21). Conversely, if the water level of the steam generator is not lower than the high water level, the temperature of the steam generator is compared with the safety temperature (S23). If the temperature of the steam generator is lower than the safety temperature Temp_crit (S23), the pump is rotated reverse for a predetermined time, for example, for approximately thirty seconds, to withdraw the water remaining in the steam generator (S25). However, if the temperature of the steam generator is higher than the safety temperature Temp_crit, the pump is stopped, rather than being rotated reverse to withdraw the water remaining in the steam generator (S27). Of course, the residual water can be withdrawn later if the temperature of the steam generator fulfills the above described requirement as a result of comparison performed after the lapse of the predetermined time T-delay. Here, the safety temperature Temp_crit means a maximum temperature capable of maintaining the reliability of the pump, and for example, is approximately 60° C.

Figure 22:
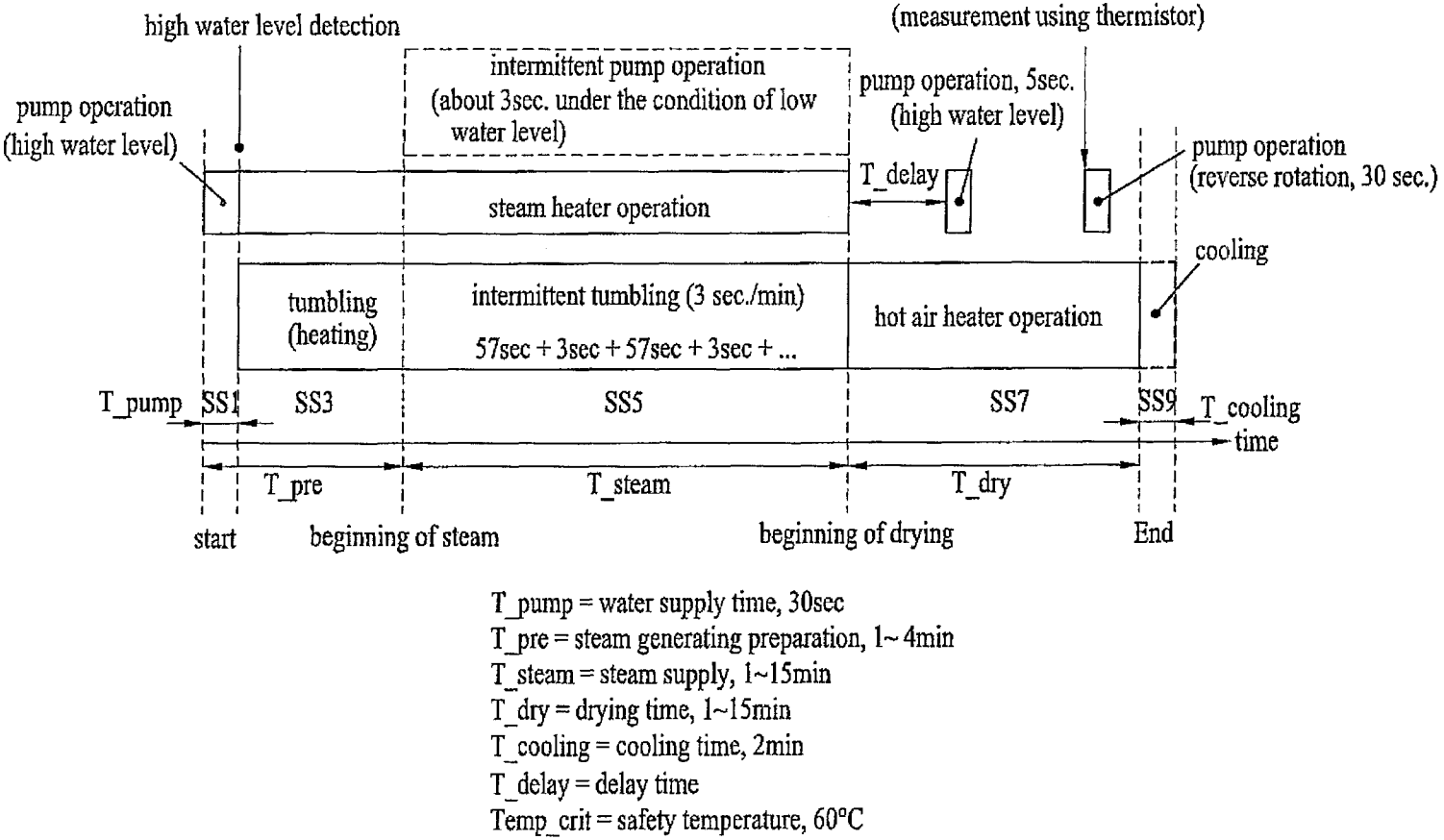
FIG. 22 is a diagram illustrating the sequence of a method for controlling the drying machine according to the present invention.
Figure 23:
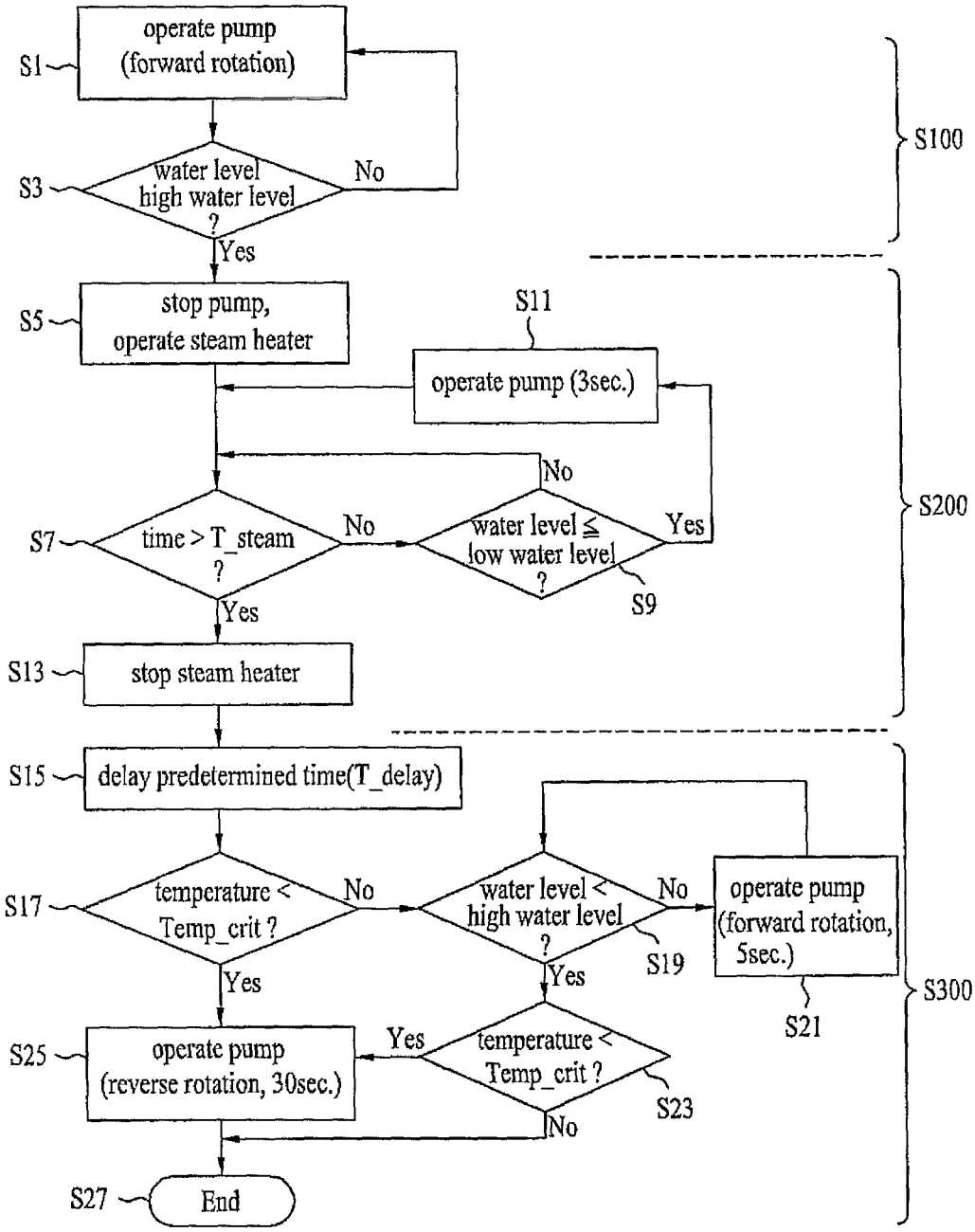
FIG. 23 is a flow chart illustrating a pump control method of FIG. 22.

Referring to FIGS. 22 and 23, the above water supply time T_pump, steam generation preparing time T_pre, steam supply time T_steam, drying time T_dry, cooling time T_cooling, delay time T_delay, tumbling time, pump operating time, etc. are given exemplary, and can be appropriately changed in consideration of the capacity of the drying machine, the amount of an object to be dried, etc.

With the results of the experiment performed by the inventors, the present invention has the effect of de-wrinkling although the efficiency of de-wrinkling may change depending on the kind of cloth, the absorption degree of steam, etc. An example of an object to be dried may include a laundry that is completely dehydrated in a washing machine, but is not limited thereto. For example, the present invention may be valuable, in particular, for removing creases generated in clothes that are worn by the wearer for approximately one day, namely, clothes that are previously dried and have a little creases. That is to say, the present invention can be used as a kind of a de-wrinkling device.

As apparent from the above description, the drying machine and the method for controlling the same according to the present invention have effects as follows.

Firstly, according to the present invention, there is an advantage in that wrinkles or creases generated in the completely dried object can be efficiently eliminated or prevented. Also, the present invention has an advantage of sterilizing and deodorizing the dried object.

Secondly, according to the present invention, it is possible to efficiently eliminate wrinkles or creases in the dried clothes without ironing.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A drying machine that treats laundry using water, the drying machine comprising:

a cabinet that defines an outer appearance and having an outer surface with an opening;

a drum rotatably mounted in the cabinet;

a water supply line provided in the cabinet that provides a passage for the water;

a container to hold the water, wherein the container is coupled to the water supply line, detachably mounted in the cabinet, slidably inserted into the opening of the cabinet, and includes an inlet through which water is supplied into the container;

a pump connected to the water supply line; and a drawer in which the container is mounted, wherein the drawer is provided in a control panel that forms a front surface of the laundry machine, wherein the inlet of the container is exposed when the drawer is drawn out from the opening of the cabinet, wherein the inlet of the container is provided at an upper portion of the container, wherein the container is detachably mounted in the drawer, wherein the container includes an opening and closing member, and wherein an inlet port of the pump is directly connected to a channel of the opening and closing member.

2. The drying machine as claimed in claim 1, further including:

a cover to close the opening.

3. The drying machine as claimed in claim 2, wherein the cover includes a front portion of a drawer in which the container is mounted.

4. The drying machine as claimed in claim 1, wherein the opening is provided at a front side of the cabinet.

5. The drying machine as claimed in claim 1, wherein the drawer is inserted into the opening.

6. The drying machine as claimed in claim 5, wherein the drawer has a front portion to cover the opening and define an outer appearance thereof.

7. The drying machine as claimed in claim 1, wherein a filter is provided at the inlet.

8. The drying machine as claimed in claim 1, wherein the drawer has an open top through which the container is detached from and mounted into the drawer.

9. The drying machine as claimed in claim 1, wherein the container is detachably coupled to the pump.

10. The drying machine as claimed in claim 1, wherein the container is coupled to or decoupled from the pump by being drawn in or out by the drawer.

11. The drying machine as claimed in claim 10, wherein the container has an outlet at a rear portion thereof to be coupled to the pump.

12. The drying machine as claimed in claim 1, wherein the opening and closing member selectively allows the container to be in fluid communication with the pump.

13. The drying machine as claimed in claim 12, wherein the opening and closing member includes the channel provided at the container, and a connector provided at the pump, and wherein the channel is engaged with the connector for the fluid communication.

14. The drying machine as claimed in claim 13, wherein the channel includes an inner channel that extends inward.

15. The drying machine as claimed in claim 13, wherein the channel includes an outer channel that extends outward.

16. The drying machine as claimed in claim 13, wherein the opening and closing member further includes a pin that moves forward and backward to selectively open and close the channel.

17. The drying machine as claimed in claim 16, wherein the pin is engaged with the channel by a spring and pushed by the connector when the channel and the connector are connected.

18. The drying machine as claimed in claim 17, wherein the connector has an outer portion having an inner diameter larger than an outer diameter of the channel and an inner portion which is inserted inside of the channel and pushes the pin.

19. The drying machine as claimed in claim 13, wherein the connector has an outer portion having an inner diameter larger than an outer diameter of the channel and an inner portion having an outer diameter smaller than an inner diameter of the channel.

20. The drying machine as claimed in claim 19, wherein the channel includes an outer channel that extends outward and inserted between the inner and outer portions.

21. The drying machine as claimed in claim 20, wherein a sealer is provided between the outer portion and the outer channel.

22. The drying machine as claimed in claim 13, wherein the channel and the connector are connected in a watertight way.

23. The drying machine as claimed in claim 13, further including:

a vertical surface provided inside of the cabinet, wherein the connector is fixed to the surface.

24. The drying machine as claimed in claim 23, wherein the connector is fixed at a front portion of the surface and the water supply line is connected to the connector at a rear portion of the surface.

25. The drying machine as claimed in claim 23, wherein the vertical surface protrudes toward the container.

26. A drying machine that treats laundry using water, the drying machine comprising:

a cabinet that defines an outer appearance and having an outer surface with an opening;

a drum rotatably mounted in the cabinet;

a water supply line provided in the cabinet that provides a passage for the water, a container to hold the water, wherein the container is detachably mounted in the cabinet, slidably inserted into the opening of the cabinet, and includes an inlet through which water is supplied into the container, wherein the container includes a drawing structure for being drawn in and out of the cabinet, wherein the inlet of the container is exposed when the drawing structure is drawn out from the opening of the cabinet, and wherein the inlet of the container is provided at an upper portion of the container; and a pump connected to the water supply line, wherein the container includes a drawer having the drawing structure and a space to hold water therein, wherein the drawer is provided in a control panel that forms a front surface of the laundry machine, wherein the container is detachably mounted in the drawer, wherein the container includes an opening and closing member, and wherein an inlet port of the pump is directly connected to a channel of the opening and closing member.

27. The drying machine as claimed in claim 26, wherein the container includes a front portion to cover the opening and define an outer appearance thereof.

28. The drying machine as claimed in claim 26, wherein the container is detachably coupled to the pump.

29. The drying machine as claimed in claim 28, wherein the container is coupled to or decoupled from the pump by being drawn in or out by the drawer.

30. The drying machine as claimed in claim 29, wherein the container has an outlet at a rear portion to be coupled to the pump.

* * * * *